US009909575B2

(12) United States Patent
Bergmann

(10) Patent No.: US 9,909,575 B2
(45) Date of Patent: Mar. 6, 2018

(54) HYDROSTATIC AXIAL PISTON MACHINE EMPLOYING A BENT-AXIS CONSTRUCTION WITH A CONSTANT VELOCITY JOINT FOR DRIVING THE CYLINDER DRUM

(71) Applicant: Linde Hydraulics GmbH & Co. KG, Aschaffenburg (DE)

(72) Inventor: Martin Bergmann, Schaafheim (DE)

(73) Assignee: Linde Hydraulics GmbH & Co. KG (DE)

( * ) Notice: Subject to any disclaimer, the term of this patent is extended or adjusted under 35 U.S.C. 154(b) by 560 days.

(21) Appl. No.: 14/446,440

(22) Filed: Jul. 30, 2014

(65) Prior Publication Data

US 2015/0075364 A1 Mar. 19, 2015

(30) Foreign Application Priority Data

Aug. 5, 2013 (DE) ..... 10 2013 108 408

(51) Int. Cl.
*F04B 1/20* (2006.01)
*F03C 1/06* (2006.01)
*F01B 3/00* (2006.01)

(52) U.S. Cl.
CPC ..... *F04B 1/2092* (2013.01); *F03C 1/0636* (2013.01); *F04B 1/20* (2013.01);
(Continued)

(58) Field of Classification Search
CPC .... F01B 3/0073; F01B 3/0076; F01B 3/0052; F01B 3/0094; F03C 1/0607; F03C 1/0636;
(Continued)

(56) References Cited

U.S. PATENT DOCUMENTS 2,721,519 A * 10/1955 Henrichsen ..... F01B 3/0032 184/109
2,968,286 A * 1/1961 Wiggermann ..... F01B 3/0038 91/500
(Continued)

FOREIGN PATENT DOCUMENTS

DE 2805492 A1 8/1979
DE 3800031 A1 7/1989
(Continued)

*Primary Examiner* — Thomas E Lazo
*Assistant Examiner* — Michael Quandt
(74) *Attorney, Agent, or Firm* — The Webb Law Firm

(57) ABSTRACT

A bent-axis hydrostatic axial piston machine (1) has a drive shaft (4) with a drive flange (3) rotatable around an axis of rotation ($R_t$) and a cylinder drum (7) rotatable around an axis of rotation ($R_z$). The cylinder drum (7) has a plurality of piston bores (8) concentric to the axis of rotation ($R_z$) of the cylinder drum (7) and having longitudinally displaceable pistons (10) fastened in an articulated manner to the drive flange (3). Between the drive shaft (4) and the cylinder drum (7) there is a drive joint (30) (constant velocity joint) for rotationally synchronous rotation of the cylinder drum (7) and the drive shaft (4). The drive joint (30) and the cylinder drum (7) include a longitudinal bore (11) concentric to the axis of rotation ($R_z$) of the cylinder drum, through which bore (11) the drive shaft (4) extends such that in the vicinity of the drive shaft (4) there is a torque transfer to a cylinder-drum-side end of the axial piston machine (1).

22 Claims, 13 Drawing Sheets

(52) U.S. Cl.
CPC ..... *F01B 3/0052* (2013.01); *F01B 3/0073* (2013.01); *F01B 3/0076* (2013.01); *F04B 1/2035* (2013.01)

(58) Field of Classification Search
CPC .... F03C 1/0647; F03C 1/0649; F03C 1/0671; F03C 1/0673; F04B 1/2028; F04B 1/2035; F04B 1/2085; F04B 1/2092; F04B 27/0804; F04B 27/0869
See application file for complete search history.

(56) References Cited

U.S. PATENT DOCUMENTS

| | | | | |
|---|---|---|---|---|
| 3,073,254 | A * | 1/1963 | Hoover | F04B 1/20 91/488 |
| 4,872,394 | A * | 10/1989 | Nakagawa | F04B 1/2035 91/506 |
| 4,896,564 | A * | 1/1990 | Eickmann | F04B 43/0063 180/243 |
| 8,850,953 | B2 | 10/2014 | Roth | |
| 2007/0101858 | A1 | 5/2007 | Jacobs et al. | |

FOREIGN PATENT DOCUMENTS

| | | | |
|---|---|---|---|
| DE | 102007011441 | A1 | 9/2008 |
| DE | 102009005390 | A1 | 7/2010 |
| EP | 0158084 | A1 | 10/1985 |
| EP | 2817164 | | 8/2013 |
| WO | 8503554 | A1 | 8/1985 |
| WO | 03046380 | A1 | 6/2003 |
| WO | 2005057009 | A1 | 6/2005 |
| WO | 2013124558 | A1 | 8/2013 |

* cited by examiner 40
67
25
26
55b
50b
27
50
A
α/2
α/2
EL
3
50a
SP
70
γ
4
S
M
67
56a
51a
30, 37
42
51
A
E
SP
56b
F
Rt
Rt
Rt
Rt
Rz
Rz
Rz

HYDROSTATIC AXIAL PISTON MACHINE EMPLOYING A BENT-AXIS CONSTRUCTION WITH A CONSTANT VELOCITY JOINT FOR DRIVING THE CYLINDER DRUM

CROSS REFERENCE TO RELATED APPLICATION

This application claims priority to German Application No. 102013108408.7 filed Aug. 5, 2013, which is herein incorporated by reference in its entirety.

BACKGROUND OF THE INVENTION

Field of the Invention

This invention relates to a hydrostatic axial piston machine employing a bent-axis construction. The machine includes a drive shaft rotatable around an axis of rotation and having a drive flange. A cylinder drum is rotatable around an axis of rotation. The cylinder drum includes a plurality of piston bores that are concentric to the axis of rotation of the cylinder drum. A longitudinally displaceable piston is located in each of the piston bores. The pistons are fastened in an articulated manner to the drive flange. Between the drive shaft and the cylinder drum, there is a drive joint in the form of a constant velocity joint for the rotationally synchronous rotation of the cylinder drum and the drive shaft.

Description of Related Art

In axial piston machines that utilize a swashplate construction, it is known that the drive shaft can be routed through the axial piston machine to make it possible to use the axial piston machine universally. In axial piston machines utilizing the swashplate construction, the longitudinally displaceable pistons in the cylinder drum are supported by a sliding shoe on a swashplate. However, on account of the high inertial forces of the pistons and of the sliding shoes located on the pistons during operation, axial piston machines that utilize a swashplate construction are limited with regard to the maximum allowable speeds of rotation. The limited maximum allowable speed of rotation of an axial piston machine with a swashplate construction has disadvantages in terms of its use as a hydraulic motor.

Axial piston machines that utilize a bent-axis construction have significantly higher maximum allowable speeds of rotation than axial piston machines that utilize a swashplate construction, as a result of which axial piston machines that utilize a bent-axis construction offer advantages in terms of their use as hydraulic motors.

In hydrostatic axial piston machines that utilize a bent-axis construction, the longitudinally displaceable pistons located in the cylinder drum are generally fastened directly or indirectly to the driving flange of the driving shaft by a ball-and-socket joint. The piston forces are supported via the pistons on the driving flange that is located on the driving shaft and generate a torque. In axial piston machines that utilize a bent-axis construction, during rotation there is naturally no driving of the cylinder drum with the pistons located in it. An additional driving device is necessary to drive the cylinder drum.

During rotation of the drive shaft, it is desirable to have the most synchronous possible driving and rotation of the cylinder drum. In the event of a non-uniform rotation of the cylinder drum, the moment of inertia of the cylinder drum with the pistons located in it would cause a non-uniform torque on the drive shaft when the axial piston machine is used as a hydraulic motor. A non-uniform torque can result in critical stresses on the components of the axial piston machine. Undesirable noises can also occur in a drive train of the axial piston machine on account of the non-uniform torque.

In axial piston machines utilizing a bent-axis construction, it is known that the cylinder drum can be driven by connecting rods which are at least partly located in the piston and connected in an articulated manner with the piston and with the drive flange by a ball-and-socket joint. The connecting rods for driving the cylinder drum are supported on the piston inside walls of the piston bores of the cylinder drum. An axial piston machine that utilizes a bent-axis construction in which the cylinder drum is driven by connecting rods is described in DE 28 05 492 C2.

Also known are axial piston machines that employ a bent-axis construction in which the cylinder drum is driven directly by the longitudinally displaceable pistons in the piston bores of the cylinder drum. These pistons are tapered and are provided with a tapered lateral surface. The pistons for driving the cylinder drum are supported with the tapered segments on the inside walls of the piston bores of the cylinder drum.

An axial piston machine of this type that utilizes a bent-axis construction with a cylinder drum driven by tapered pistons is described in DE 10 2009 005 390 A1.

In axial piston machines that utilize a bent-axis construction with the cylinder drum driven by connecting rods or by pistons, however, it is not always possible to achieve an exactly rotationally synchronous drive of the cylinder drum, on account of the limited number of pistons or connecting rods. Therefore, there is a non-uniformity of the rotational motion in the drive of the cylinder drum. This is a disadvantage for use as a hydraulic motor. An additional disadvantage of axial piston machines that employ a bent-axis construction with a cylinder drum driven by connecting rods or pistons is that when the axial piston machine is a variable displacement machine, when the cylinder drum pivots back to a lower displacement volume, there is play between the cylinder drum and the drive shaft. The play results in an undesirable lack of synchronization between the drive shaft and the cylinder drum, which leads to an additional tangential orientation of the connecting rods or of the tapered pistons. The tangential orientation of the connecting rods or of the tapered pistons results in tangential force components that lead to a high level of reactive torque, which must be transmitted via the connecting rods or pistons, which in turn results in high stresses on the components in terms of strength and tribology.

To achieve a synchronous rotation of the cylinder drum and the drive shaft on bent-axis axial piston machines utilize as a hydraulic motor, constant velocity joints are used as the drive link for rotationally synchronous drive of the cylinder drum. On known bent-axis axial piston machines, constant velocity joints employ the Rzeppa principle (in which roller bodies in the form of spheres (balls) that run in groove-shaped tracks in the drive flange and the cylinder drum transmit the torque between the drive shaft and the cylinder drum) or the tripod principle (in which a coupling shaft is located between the cylinder drum and the drive shaft and both ends of the coupling shaft have finger-like bearing pins on which are mounted the roller-shaped roller bodies that run in corresponding grooves (tracks) on the drive flange and the cylinder drum and transmit the torque to drive the cylinder drum). A bent-axis axial piston machine that employs a constant velocity joint according to the Rzeppa principle is described in from DE 38 00 031 C2. Although constant velocity joints that utilize the Rzeppa principle or the tripod principle result in a rotationally synchronous drive of the cylinder drum, they are difficult and expensive to manufacture on account of the complex tracks for the balls or rollers. In addition, at sufficiently high levels of torque transmitted to drive the cylinder drum, high Hertzian stresses occur on the roller bodies which, in constant velocity joints of this type, are in the form of balls or rollers and require that the tracks be hardened to a significant depth. During the necessary hardening by a suitable heat treatment of the components provided with the tracks for the roller bodies, a change in the dimensions of the hardened components that contain the tracks occurs. This requires complicated, expensive, and time-consuming mechanical reworking operations on the hardened components. In other words, constant velocity joints that employ the Rzeppa or tripod principle require a high level of manufacturing effort and expense for a bent-axis machine.

On bent-axis axial piston machines of the type described above with a constant velocity joint to drive the cylinder drum, an additional disadvantage is that the drive shaft cannot be routed through the axial piston machine because the constant velocity joints that are designed according to the Rzeppa principle or according to the tripod principle are located at the intersection of the axis of rotation of the cylinder drum with the axis of rotation of the drive shaft. On bent-axis axial piston machines utilizing a constant velocity joint for driving of the cylinder drum, when the axial piston machine is in the form of a motor, the output of the torque, and when the axial piston machine is in the form of a pump, the drive by a torque, can occur only on one side, as a result of which the potential applications of the axial piston machine are limited. For applications of bent-axis machines in which torque is to be output on both sides or a torque for the operation of an additional user must be transferred through the axial piston machine, on known bent-axis axial piston machines additional components, such as transfer cases, are necessary to allow a universal use of the axial piston machine.

On bent-axis axial piston machines in which a constant velocity joint that utilizes the Rzeppa principle or the tripod principle is used for driving of the cylinder drum, an additional disadvantage is that the drive shaft equipped with the drive flange must be mounted in a cantilevered fashion in a housing of the axial piston machine, as a result of which the overall length of the axial piston machine is increased by the requirement for a bearing base for the two bearings of the drive shaft.

Therefore, it is an object of this invention to provide an axial piston machine utilizing the bent-axis construction of the general type described above with a constant velocity joint for driving the cylinder drum but which is both compact and can be used in a simple manner for universal applications.

SUMMARY OF THE INVENTION

To accomplish this object, the invention teaches that the drive joint and the cylinder drum include a longitudinal bore concentric to the axis of rotation of the cylinder drum. The drive shaft provided with the drive flange extends through the bore and through the cylinder drum. A transfer of a torque to a cylinder-drum-side end of the axial piston machine is provided in the vicinity of the drive shaft. As a result of the longitudinal bore in the drive joint (in the form of a constant velocity joint) and in the cylinder drum, it is possible to route the drive shaft through the cylinder drum and the axial piston machine to achieve a transfer of torque in the axial piston machine. When the bent-axis axial piston machine is used as a hydraulic motor, the transfer of the torque to the cylinder-drum-side end of the axial piston machine makes it possible to divert and tap the torque on both sides of the drive shaft. When the bent-axis axial piston machine is used as a hydraulic pump, the additional torque transfer capability on the drive shaft makes it possible to locate and drive a plurality of axial piston machines operating as hydraulic pumps and located one behind the other without having to use a complex transfer case. In addition, the ability to transfer a torque on the drive shaft makes it possible to locate a plurality of bent-axis axial piston machines one behind another as hydraulic motors to increase the torque output. As a result of the ability to transfer a torque via the drive shaft routed through the axial piston machine, the axial bent-axis piston machine of the invention is suitable for universal applications in which a torque transfer capability makes it possible to tap torque on both sides of the drive shaft or to conduct torque through the axial piston machine via the drive shaft for driving an additional user.

In one preferred development of the invention, the drive shaft is mounted on both sides of the cylinder drum in a housing of the axial piston machine. The longitudinal bore in the constant velocity joint and in the cylinder drum and the resulting ability to route the drive shaft through the cylinder drum makes it possible to mount the drive shaft having the drive flange on both sides of the cylinder drum in the housing. This arrangement achieves a broad bearing base for the drive shaft, as a result of which a compact length of the axial piston machine of the invention becomes possible, compared to a unilateral cantilevered mounting of the drive shaft provided with the drive flange.

In one advantageous development of the invention, the drive shaft is provided with torque transmission means on both ends for the transmission of torque. This makes possible the universal use of the axial piston machine of the invention, in which a torque can be tapped on both sides of the drive shaft or a torque for the drive of an additional user can be transferred through the axial piston machine. On the drive flange end, the drive shaft includes splined gear teeth as the torque transmission means. On the opposite, cylinder-drum-side end of the drive shaft, splined gear teeth or a polygon joint or a feathered key connection can likewise be provided as torque transmission means for the transfer of the torque on an axial piston machine used as a hydraulic pump or as a hydraulic motor, and for tapping of the torque on an axial piston machine used as a hydraulic motor toward both sides.

In one advantageous development of the invention, the drive shaft is a hollow shaft, through which a torque bar that runs through the axial piston machine is routed for the transfer of a torque. The realization of the drive shaft in the form of a hollow shaft makes it possible to route a torque bar through the drive shaft, by means of which a torque that is independent of the torque of the drive shaft can be transferred through the axial piston machine. This measure further improves the possibilities for the universal use of the axial piston machine of the invention.

It is particularly advantageous if, as in one development of the invention, the torque bar has no mechanical operative connection with the drive shaft. If the torque bar routed through the axial piston machine does not have a permanent (fixed) connection to the drive shaft, there are additional advantages in terms of the universal applicability of the axial piston machine because different speeds of rotation and/or different directions of rotation can be present on the hollow drive shaft and on the torque bar routed through the hollow drive shaft. Therefore, two different torques with different speeds of rotation and/or different directions of rotation can be present on the drive shaft and the torque bar.

In one advantageous development to the invention, the drive joint is a constant velocity joint in the form of a cone-beam semi-roller joint. The cone-beam semi-roller joint is formed by at least one pair of rollers with two semi-cylindrical half-rollers. The semi-cylindrical half-rollers are flattened along an axis of rotation and these half-rollers form planar sliding surfaces on the flattened sides. The half-rollers of the roller pair are in contact with each other on the flattened sides. With a drive joint in the form of a cone-beam semi-roller joint, it is possible, with little added construction effort or expense, to achieve a drive of the cylindrical drum on a bent-axis axial piston machine. A cone-beam semi-roller joint between the drive shaft and the cylinder drum can be manufactured in a simple manner by a corresponding geometric design as a homokinetic constant velocity joint that achieves an exact and uniform drive of the cylinder drum. In addition, with a cone-beam semi-roller joint located between the drive shaft and the cylinder drum as a drive joint for driving the cylinder drum, it is easily possible to route the drive shaft through the axial piston machine in the axial direction. This makes it possible to transfer the torque, so that the axial piston machine can be used in universal applications in which the objective is to tap the torque on both sides of the drive shaft on account of the torque transfer capability, or a torque is to be transferred through the axial piston machine for the drive of an additional user. With a cone-beam semi-roller joint, the half-rollers of each pair of rollers are arranged in pairs. The half-rollers of a roller pair of the cone-beam semi-roller joint are formed by cylindrical bodies flattened along the axis of rotation and therefore along the longitudinal axis. As a result of the flattening, flat sliding surfaces are formed as contact surfaces on the flattened sides, on which the two half-rollers of a roller pair are in contact with each other and the force is transmitted by contact between the flat surfaces. With a roller pair of this type, each having two semi-cylindrical half-rollers flattened along an axis of rotation and, thus, the longitudinal axis of the half-rollers, and which are in contact with one another on the flattened side, the forces and, thus, the torque for driving the cylinder drum can be transmitted with little added construction effort or expense because the half-rollers can be manufactured simply and economically. Because the contact surfaces between the two half-rollers of a roller pair are in the form of flat sliding surfaces and there is area contact between the two half-rollers of a roller pair, even in the event of high forces transmitted during driving of the cylinder drum, the Hertzian stresses that occur are low. The cone-beam semi-roller joint formed by the corresponding roller pairs is therefore robust enough to withstand an overload of the type that can occur, for example, as a result of high rotational acceleration. When the axial piston machine is a hydraulic motor, the axial piston machine can also be used in applications with high rotational accelerations. As a result of the area contact in the vicinity of the contact surfaces of the two half-rollers of a roller pair, the only treatment that is required on the half-rollers of the conical beam half-roller joint is a treatment of the flattened sides to protect them against wear. With a treatment of this type with limited surface hardening, only negligible, process-induced changes in the dimensions of the half-rollers occur, so that mechanical refinishing or reworking of the half-rollers is not necessary. The cost and effort required for the manufacture of the bent-axis axial piston machine can therefore be reduced because the cone-beam semi-roller joints are so simple to manufacture.

It is particularly advantageous if, as in one embodiment of the invention, the half-rollers are located in the radial direction inside the pistons and at a distance from the axis of rotation of the drive shaft and the cylinder drum. The cone-beam semi-roller joint is therefore inside the rim and the reference circle of the pistons, as a result of which a compact construction of the axial piston machine becomes possible. In addition, the half-rollers of the roller pairs are at perpendicular distances from the axis of rotation of the drive shaft and the axis of rotation of the cylinder drum so that the torque to drive the cylinder drum can be transmitted on the contact surfaces formed by the plane sliding surfaces. This arrangement of the half-rollers of the cone-beam semi-roller joint also makes it possible in a simple manner to provide the cone-beam semi-roller joint with a longitudinal bore that is concentric with the axis of rotation of the cylinder drum, to route the drive shaft through the cylinder drum and the axial piston machine and to create a torque transfer capability.

In one advantageous embodiment of the invention, each pair of rollers has one cylinder-drum-side half-roller that belongs to the cylinder drum and one drive shaft-side half-roller that belongs to the drive shaft. The cylinder-drum-side half-roller of a pair of rollers is located in a cylindrical or partly cylindrical, cylinder-drum-side receptacle and the drive-shaft-side half-roller of a pair of rollers is located in a cylindrical or partly cylindrical, drive-shaft-side receptacle. With roller pairs of this type, the forces and a torque to drive the cylinder drum can be transmitted in a simple fashion. The cylindrical receptacles in which the corresponding half-rollers are held and embedded can be manufactured easily and economically, as a result of which, in connection with the half-rollers themselves, which are also simple and economical to manufacture, the drive joint for driving the cylinder drum can be produced with little manufacturing effort and expense.

In one embodiment of the invention, the axis of rotation of the drive shaft-side half-roller is inclined at an angle with respect to the axis of rotation of the drive shaft and intersects the axis of rotation of the drive shaft. If a plurality of drive shaft-side half-rollers are provided, their axes of rotation form a cone-beam with reference to the drive shaft. Accordingly, the axis of rotation of the cylinder-drum-side half-roller is inclined at an angle with reference to the axis of rotation of the cylinder drum, and intersects the axis of rotation of the cylinder drum. If a plurality of cylinder-drum-side half-rollers are provided, their axes of rotation likewise form a cone-beam with reference to the cylinder drum.

It is particularly advantageous if, as in one embodiment of the invention, the angles of inclination are identical and intersect the axis of rotation of the cylinder-drum-side half-roller and the axis of rotation of the drive shaft side half-roller of each pair of rollers in a plane that is perpendicular to the line bisecting the angle between the axis of rotation of the drive shaft and the axis of rotation of the cylinder drum. The half-rollers of a roller pair are located in the vicinity of the intersection of the axes of rotation of the half-rollers. If the angle of inclination of the axes of rotation of the half-rollers for the drive shaft and for the cylinder drum (and thus for the two components to be coupled together) are equal and therefore identical, the respective axes of rotation of the half-rollers that belong to the drive shaft intersect in pairs and, therefore, for each pair of rollers with the axes of rotation of the half-rollers that belong to the cylinder drum in a plane that is inclined at one-half the pivoting angle. The pivoting angle equals the angle of inclination of the axis of rotation of the cylinder drum with respect to the axis of rotation of the drive shaft. The points of intersection of the axes of rotation of the pairs of rollers lie in a plane perpendicular to the line bisecting the angle between the axis of rotation of the drive shaft and the axis of rotation of the cylinder drum. The transmission of force to drive the cylinder drum occurs at these points of intersection on the two half-rollers of each pair in contact with each other at the flat sliding surfaces. The position of the points of intersection of the axes of rotation of the half-rollers of each roller pair on the line bisecting the angle means that the perpendicular (and thus radial) distances of the points of intersection from the axis of rotation of the cylinder drum and from the axis of rotation of the drive flange are equal. The equal lever arms formed by the equal distances result in equal angular velocities and a uniform rotation. The realization of equal angles of inclination of the half-rollers of the roller pairs of the cone-beam semi-roller joint, makes it possible to design the cone-beam semi-roller joint in the form of a constant velocity joint, which with little added construction effort and expense makes possible a rotationally synchronous drive of the cylinder drum.

The axial piston machine of the invention can be operated in only one direction of rotation. Thus, it is sufficient for this direction of rotation to provide one or more pairs of rollers that make possible a transmission of the drive torque in the desired direction of rotation between the drive shaft and the cylinder drum.

In one advantageous embodiment of the invention, the axial piston machine can be operated in both directions of rotation, whereby for each direction of rotation at least one pair of rollers is provided for the rotationally synchronous drive of the cylinder drum. This arrangement achieves in a simple manner, transmission of the drive torque in both directions of rotation between the drive shaft and the cylinder drum. The drive joint in the form of a cone-beam semi-roller joint is therefore suitable for applications of the axial piston machine as a hydraulic motor that is operated in both directions of rotation.

Depending on the torque to be transmitted between the drive shaft and the cylinder drum, if the torques to be transmitted are small, it may be sufficient to provide only a single pair of rollers for each direction of rotation and, thus, each direction of torque of the drive torque. For higher torques to be transmitted between the drive shaft in the cylinder drum, the number of roller pairs for the corresponding direction of rotation can be increased. If a plurality of roller pairs, in particular at least two roller pairs, are distributed, preferably uniformly distributed, over the periphery, a radial equalization of forces for each direction of the drive torque is achieved.

In one development of the invention, the individual half-roller located in a cylindrical receptacle is secured in the receptacle in the longitudinal direction of the axis of rotation. This measure makes it possible to prevent the half-roller from slipping out of the respective individual cylindrical receptacle during operation of the axial piston machine.

A securing of the half-roller in the longitudinal direction of this type can be achieved with little added construction effort or expense if the half-rollers are provided on the cylindrical section with a collar engaged in a groove of the receptacle. A collar in the form of an annular collar, or a groove in the form of an annular groove, can be simply and economically provided on the corresponding half-roller or the corresponding receptacle simply and economically and makes it possible to axially secure the individual half-roller in the associated receptacle.

The drive-shaft-side receptacles for the drive shaft-side half-rollers of the corresponding roller pairs of the cone-beam semi-roller joint can be located in the drive shaft or in the drive flange so that the drive shaft-side half-rollers of the corresponding roller pairs are supported directly on the drive shaft.

As an alternative to a direct support of the drive-shaft-side half-rollers of the corresponding roller pairs on the drive shaft, the drive-shaft-side receptacles can be located in a component that is connected with the drive shaft in a torque-proof manner. This arrangement can have advantages in terms of ease of manufacture and fabrication of the drive-shaft-side receptacles. The component provided with the drive-shaft-side receptacles can be connected easily with the drive shaft in a torque-proof manner by a positive or non-positive torque connection.

In one embodiment of the invention, the drive flange can be formed in one piece on the drive shaft. In addition, it is alternatively possible to make the drive flange and the drive shaft separate pieces, in which case the drive flange is fastened on the drive shaft in a torque-proof manner. The drive flange is thereby separate from the drive shaft and can be connected torque-tight to the drive shaft by a suitable torque connection, such as a shaft-hub connection formed by splined shaft teeth.

In one advantageous development of the invention, the cylinder-drum-side receptacle is located in a sleeve-shaped driver element located in the longitudinal bore of the cylinder drum and connected in a torque-proof manner with the cylinder drum. The drive shaft extends through the sleeve-shaped driver element. As a result of the location and configuration of the cylinder-drum-side receptacles for the cylinder-drum-side half-rollers of the cone-beam semi-roller joint in a sleeve-shaped driver element connected in a torque-proof manner with the cylinder drum, advantages can be achieved with regard to ease of manufacture and fabrication of the cylinder-drum-side receptacles. The driver element provided with the cylinder-drum-side receptacles can be connected easily with the cylinder drum in a torque-proof manner by a positive or non-positive torque connection. In addition, the drive shaft can be routed in a simple manner through the interior of the sleeve-shaped driver element through the drive joint, which is in the form of the cone-beam semi-roller joint, through the cylinder drum, and through the axial piston machine.

The sleeve-shaped driver element is advantageously located in a torque-proof manner in the longitudinal bore of the cylinder drum. This placement achieves a coaxial arrangement of the cylinder drum and the driver element, which makes it possible with little added construction effort or expense to extend the drive shaft through the sleeve-shaped driver element and thus through the driver joint, which is in the form of a cone-beam semi-roller joint.

In one advantageous development of the invention, a spherical guide formed by a sphere and a spherical shell for bearing the cylinder drum is located between the drive shaft and the sleeve-shaped driver element. With a spherical guide formed by a spherical segment on the drive shaft and a segment in the shape of a hollow sphere on the sleeve-shaped driver element, it becomes easily possible on an axial piston machine of the invention with a torque transfer capability to center and support the cylinder drum. This arrangement also ensures that the roller pairs of the cone-beam semi-roller joint located between the drive joint and the drive shaft are located in the vicinity of the spherical guide, as a result of which a compact construction of the axial piston machine is achieved.

In one advantageous development of the invention, the driver element is provided with at least one finger-shaped protrusion which extends toward the drive shaft and in which a cylinder-drum-side receptacle for a cylinder-drum-side half-roller is formed. With finger-shaped protrusions of this type on the sleeve-shaped driver element, it becomes easily possible to locate the two half-rollers of the roller pair for the transmission of the drive torque between the drive drum and the drive shaft.

In one particularly advantageous development of the invention, the drive shaft or the drive flange or the component which is connected in a torque-proof manner with the drive shaft, is provided with at least one pocket-shaped recess, in which the driver element is engaged with a finger-shaped protrusion. A drive-shaft-side receptacle for a drive-shaft-side half-roller is formed in each pocket-shaped recess. The finger-shaped protrusion on the driver element and the cylinder drum are each engaged in a pocket-shaped drive-shaft-side recess, which results in a compact arrangement of the drive joint in the form of a cone-beam semi-roller joint between the drive shaft and the cylinder drum.

The axial piston machine of the invention can be a constant displacement machine with a constant displacement volume.

On the driver joint, which is in the form of a cone-beam semi-roller joint and which can be easily realized in the form of a constant velocity joint, for the drive of the cylinder drum, a variation of the pivoting angle, i.e., of the axes of rotation of the drive shaft and the cylinder drum with respect to each other, is also possible, so that the driver joint (the cone-beam semi-roller joint) is suitable for use in a variable displacement machine with a variable displacement volume. The drive joint in the form of a cone-beam semi-roller joint has the additional advantage that in the event of a decrease of the pivoting angle by a reverse pivoting of the cylinder drum, no play, with the associated disadvantages, results as it does on the axial piston machines utilizing a bent-axis construction where the cylinder drum is driven by connecting rods or pistons.

The invention further relates to a power split transmission with an axial piston machine as described above. On account of the construction of the drive shaft of the axial piston machine utilizing a bent-axis construction in the form of a hollow shaft, through which a torque bar that runs through the axial piston machine is routed, which torque bar can be operated at a speed of rotation that is independent of the speed of rotation of the drive shaft and/or which can be operated in the same direction of rotation as the drive shaft or in a different direction of rotation from the drive shaft, there are particular advantages with a power split transmission because the torque of the hydrostatic branch of the power split transmission can be present on the drive shaft and the torque of the mechanical branch of the power split transmission can be present on the torque bar.

BRIEF DESCRIPTION OF THE DRAWINGS

Additional advantages and details of the invention are described in greater detail below with reference to the exemplary embodiments illustrated in the accompanying schematic figures, in which like reference numbers identify like parts throughout.

DESCRIPTION OF THE PREFERRED EMBODIMENTS

Figure 1:
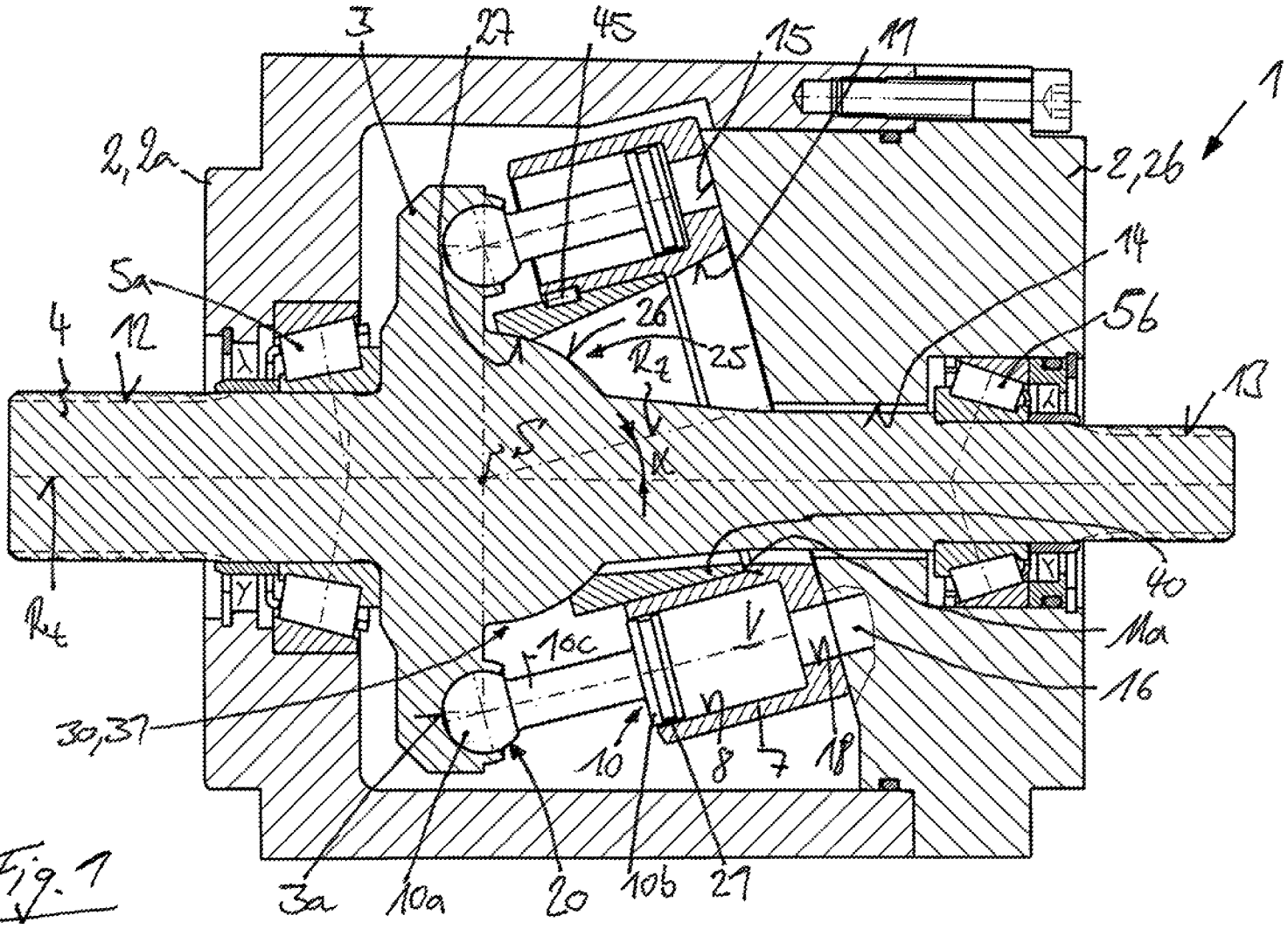
FIG. 1 is a longitudinal section of a first exemplary embodiment of a bent-axis machine of the invention.

The bent-axis hydrostatic axial piston machine 1 illustrated in FIG. 1 has a housing 2, which includes a housing pot 2*a* and a housing cover 2*b*. In the housing 2, a drive shaft 4 provided with the drive flange 3 is rotationally mounted by bearings 5*a*, 5*b* so that it can rotate around an axis of rotation $R_t$. In the illustrated exemplary embodiment, the drive flange 3 is in one piece with the drive shaft 4.

Located axially next to the drive flange 3 in the housing 2 is a cylinder drum 7, which is provided with a plurality of piston bores 8 arranged concentrically to an axis of rotation $R_z$ of the cylinder drum 7. In each piston bore 8, there is a longitudinally displaceable piston 10.

The axis of rotation $R_t$ of the drive shaft 4 intersects the axis of rotation $R_z$ of the cylinder drum 7 at the intersection point S.

In the illustrated exemplary embodiment, the cylinder drum 7 includes a central longitudinal bore 11 that is concentric with the axis of rotation $R_z$ of the cylinder drum 7. The drive shaft 4 extends through the bore 11. The drive shaft 4 routed through the axial piston machine 1 is supported by the bearings 5*a*, 5*b*, on both sides (bilateral) of the cylinder drum 7. The drive shaft 4 is supported by the bearing 5*a* in the housing pot 2*a* and by the bearing 5*b* in the housing cover 2*b*.

The drive shaft 4 is provided on the drive flange side-end with torque transmission means 12, such as splined gear teeth, to transmit a drive torque or to tap an output torque. The opposite, cylinder-drum-side end of the drive shaft that extends through the axial piston machine 1 extends out of the housing cover 2*b* and has torque transmission means 13. The torque transmission means 13 on the shaft stub of the drive shaft 4 that extends out of the housing cover 2*b* are preferably in the form of splined gear teeth or a polygon profile or a feather key connection. The drive shaft 4 makes possible a transfer of torque through the axial piston machine 1. A torque can be transferred through the axial piston machine 1 or, on an axial piston machine 1 in the form of a hydraulic motor, can make possible a bilateral output of torque. For this purpose, there is a through hole 14 in the housing cover 2*b* for the drive shaft 4 that is concentric with the axis of rotation $R_t$ of the drive shaft 4.

The axial piston machine illustrated in FIG. 1 is a constant displacement machine with a fixed displacement volume. The axis of rotation $R_z$ of the cylinder drum 7 is at a constant angle of displacement or pivot angle $\alpha$ with respect to the axis of rotation $R_t$ of the drive shaft 4.

For control of the feed and discharge of hydraulic fluid in the displacement chambers V formed by the piston bores 8 and the pistons 10, the cylinder drum 7 is in contact with a control surface 15 formed on the housing cover 2*b*. The control surface has kidney-shaped control bores (not illustrated in detail) and form an admission connection 16 and a discharge connection of the axial piston machine 1. For connection of the displacement chambers V formed by the piston bores 8 and the pistons 10 with the control bores located in the housing cover 2*b*, the cylinder drum 7 is provided with a control opening 18 at each piston bore 8.

The pistons 10 are each fastened to the drive flange 3 in an articulated manner. Between each piston 10 and the drive flange 3 there is an articulated connection 20 in the form of a spherical joint. In the illustrated exemplary embodiment, the articulated connection 20 is in the form of a ball-and-socket joint formed by a spherical head 10*a* of the piston 10 and a spherical shell 3*a* in the drive flange 3 in which the piston 10 is fastened with the spherical head 10*a*.

The pistons 10 each have a collar segment 10*b* by means of which the piston 10 is located in the piston bore 8. A piston rod 10*c* of the piston 10 connects the collar segment 10*b* with the spherical head 10*a*.

To make possible a compensating movement of the pistons 10 during rotation of the cylindrical drum 7, the collar segment 10*b* of the piston 10 is located in the piston bore 8 with some clearance or play. The collar segment 10*b* of the piston 10 can be spherical. To create a seal between the pistons 10 and the piston bores 8, sealing means 21, such as a piston ring, are located on the collar segment 10*b* of the piston 10.

For bearing and centering of the cylinder drum 7, there is a spherical guide 25 between the cylinder drum 7 and the drive shaft 4. The spherical guide 25 is formed by a spherical segment 26 of the drive shaft 4 on which is located the cylinder drum 7 with a segment 27 in the shape of a hollow sphere in the vicinity of the central longitudinal bore 11. The midpoint of the segments 26, 27 lies at the intersection S of the axis of rotation $R_t$ of the drive shaft 4 and the axis of rotation $R_z$ of the cylinder drum 7.

To drive the cylinder drum 7 during operation of the axial piston machine 1, between the drive shaft 4 of the cylinder drum 7 there is a drive joint 30 that couples the drive shaft 4 and the cylinder drum 7 in their direction of rotation. The drive joint 30 is a constant velocity joint which makes possible a rotationally synchronous drive of the cylinder drum 7 with the drive shaft 4, resulting in a uniform, synchronous rotation of the cylinder drum 7 with the drive shaft 4.

The drive joint 30, which is in the form of a constant velocity joint and is not illustrated in any further detail is a cone-beam semi-roller joint 31.

The construction of the cone-beam semi-roller joint 31, with which the cylinder drum 7 and the drive shaft 4 are rotationally synchronously coupled, is described in greater detail below with reference to FIGS. 4 to 12.

The cone-beam semi-roller joint 31 is formed by a plurality of roller pairs 50, 51, 52, 53, located between the drive shaft 4 and a sleeve-shaped driver element 40 connected in a torque-proof manner with the cylinder drum 7.

The sleeve-shaped driver element 40 is located in the central longitudinal bore 11 of the cylinder drum 7. The driver element 40 is secured to the cylinder drum 7 in the longitudinal direction of the cylinder drum 7 in the axial direction and in the peripheral direction. For the axial securing, the driver element 40 is in contact with an end surface on a diametric shoulder 11*a* of the longitudinal bore 11. The driver element 40 is held in a torque-proof manner by securing means 45, which in the illustrated exemplary embodiment are formed by a connecting pin located between the sleeve-shaped driver element 40 and the cylinder drum 7. The drive shaft 4 routed through the axial piston machine 1 likewise extends through the sleeve-shaped driver element 40. The inside diameter of the sleeve-shaped driver element 40 is provided with a contour that is in alignment with the longitudinal bore 11 of the cylinder drum 7.

Figure 9:
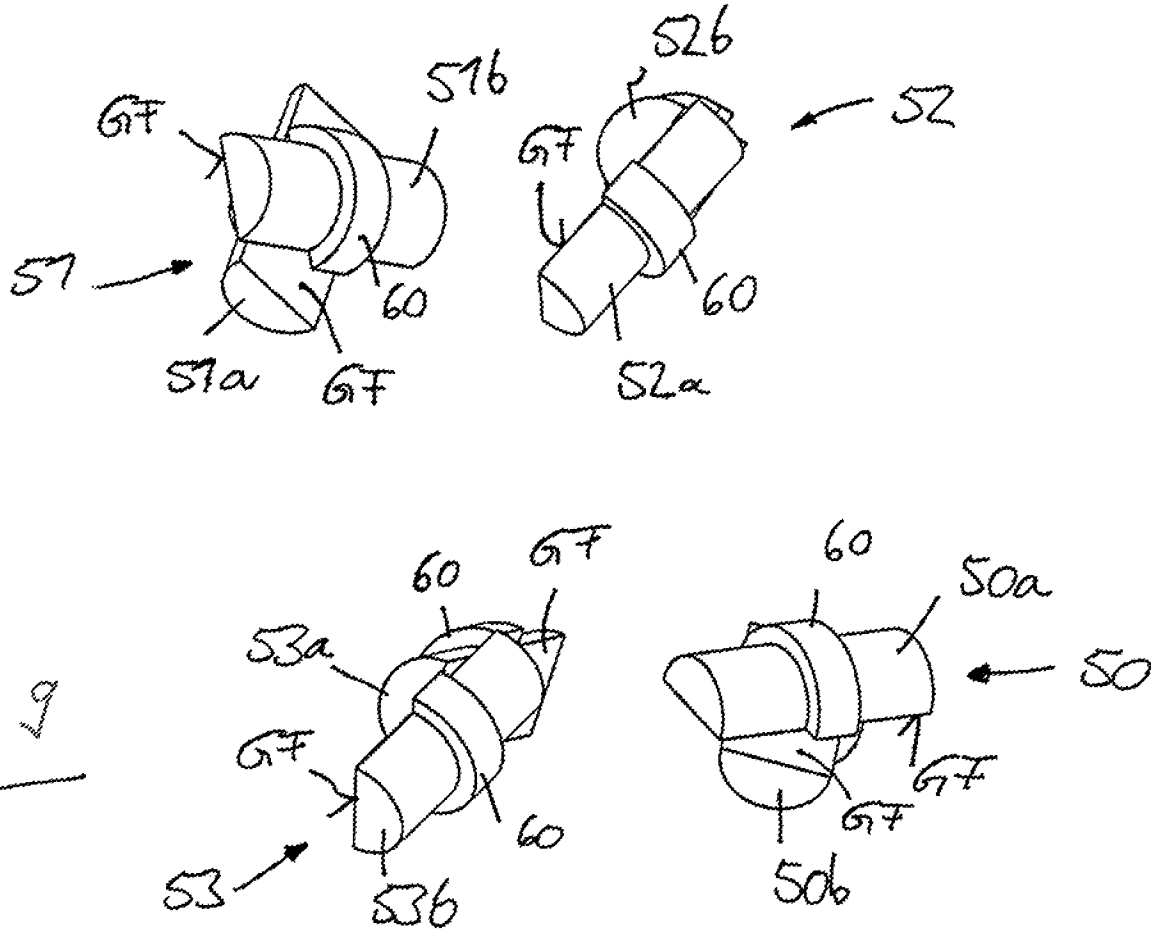
FIG. 9 is an illustration of the roller pairs in FIGS. 7 and 8.
Figure 10:
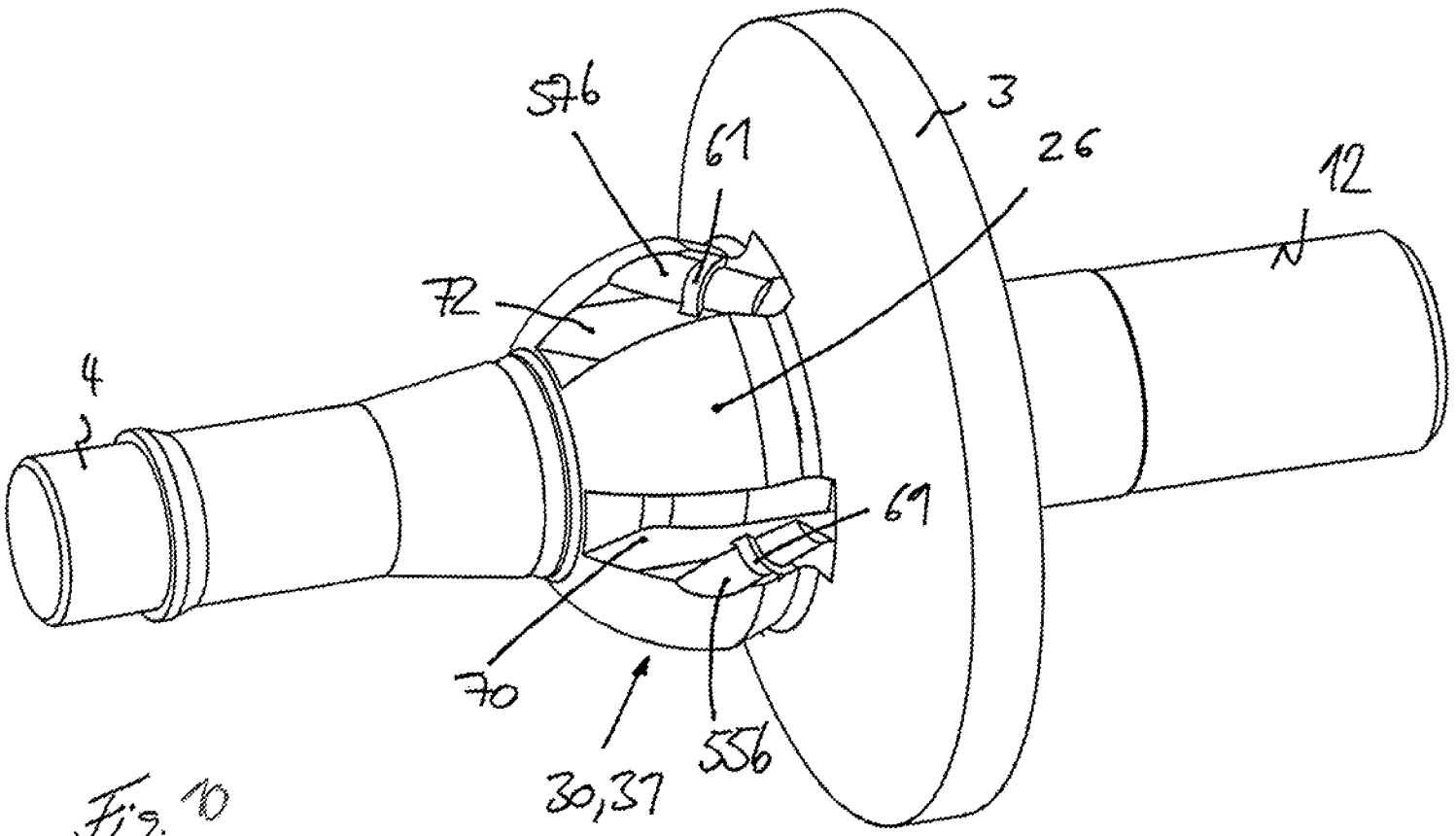
FIG. 10 is a three-dimensional representation of the drive shaft of the invention.
Figure 11:
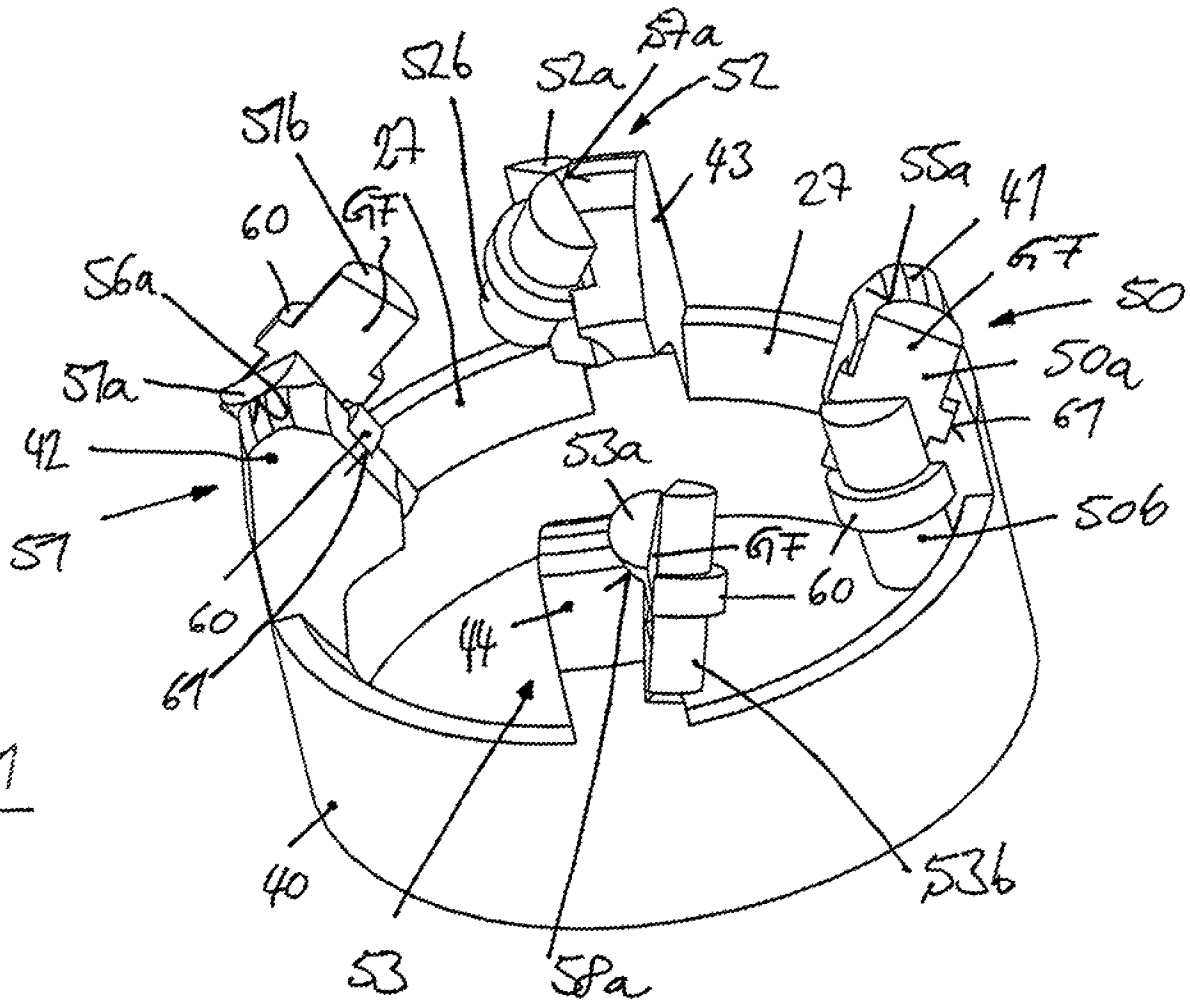
FIG. 11 is a three-dimensional representation of the driver element of the drive joint with the roller pairs.
Figure 12:
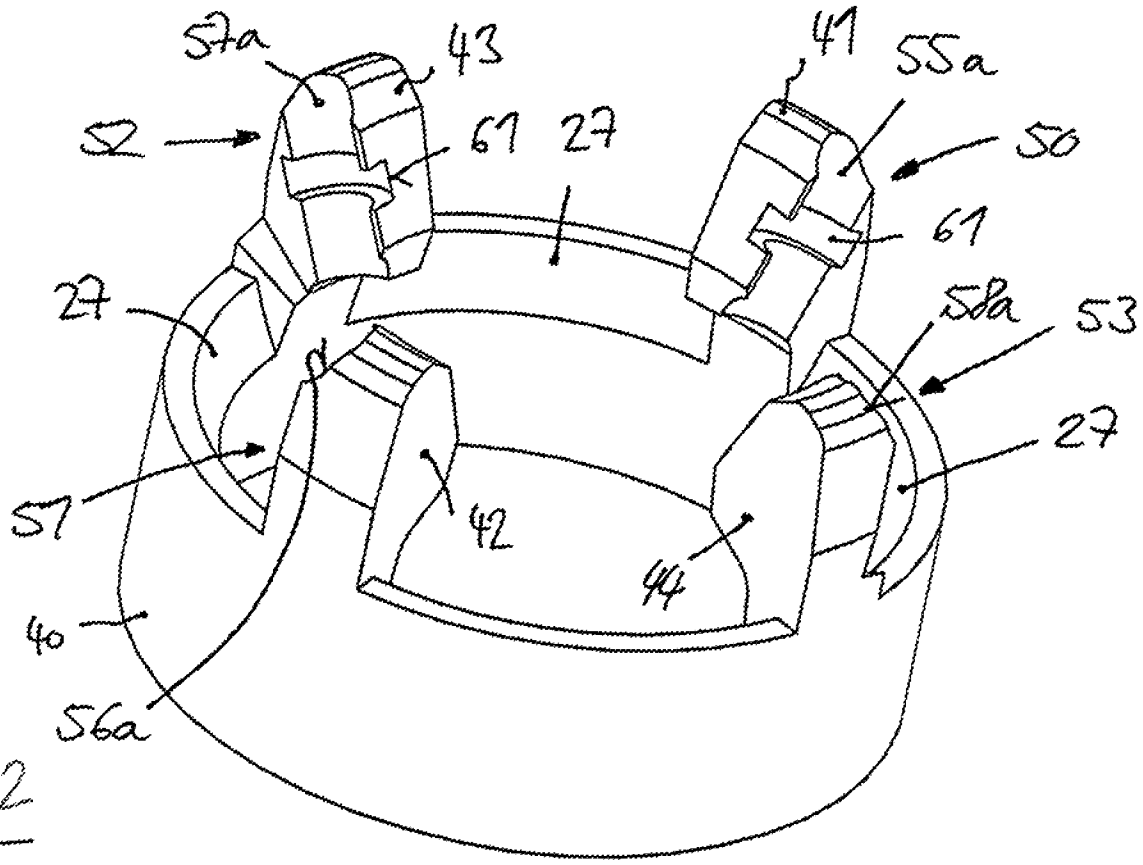
FIG. 12 is a view as in FIG. 11 without the roller pairs of the drive joint.
Figure 13:
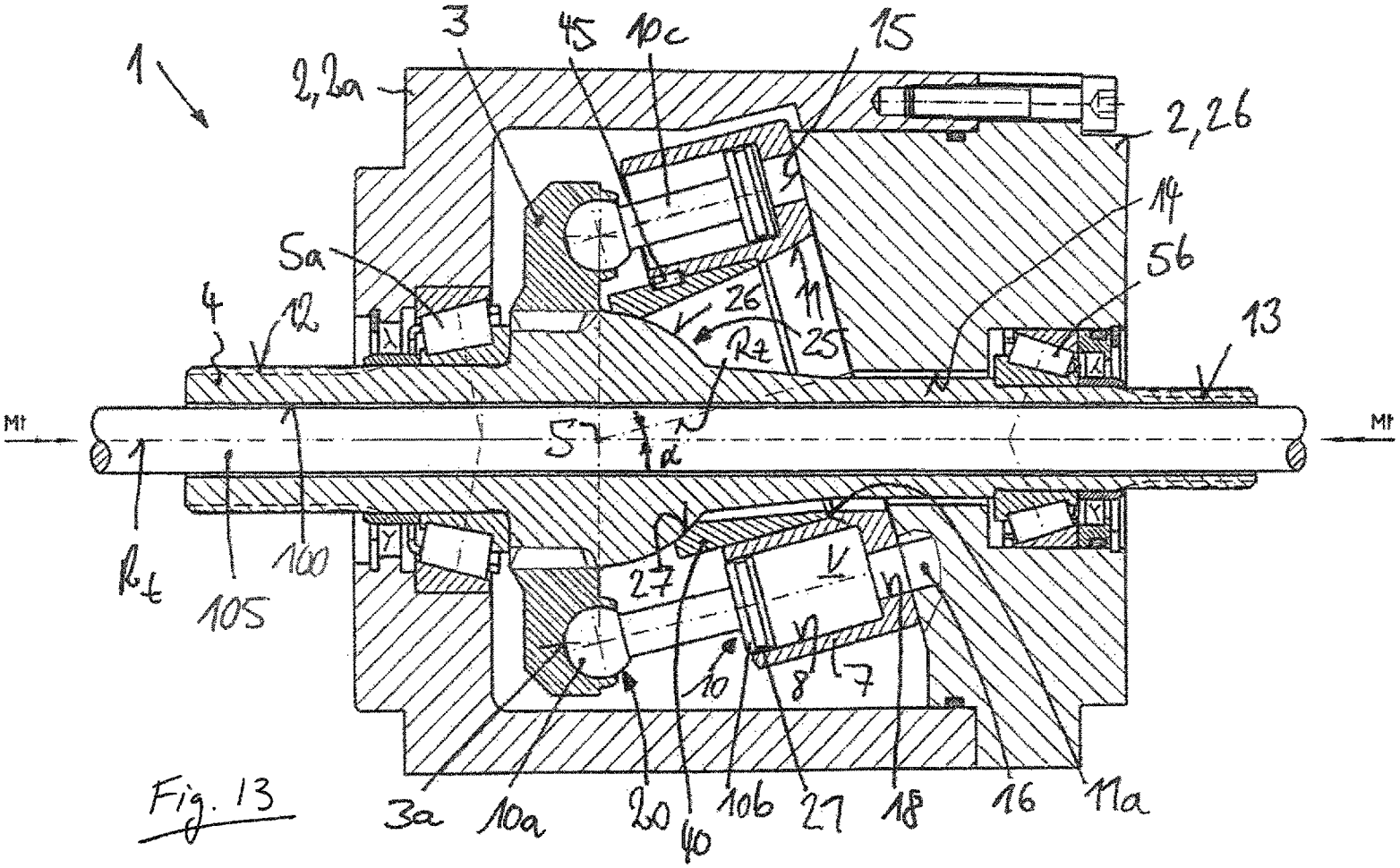
FIG. 13 is a longitudinal section of a fourth exemplary embodiment of a bent-axis machine of the invention.

Each of the plurality of roller pairs 50-53 of the cone-beam semi-roller joint 31 includes two semi-cylindrical half-rollers 50*a*, 50*b*, 51*a*, 51*b*, 52*a*, 52*b*, 53*a*, 53*b*, which form pairs. The semi-cylindrical half-rollers 50*a*, 50*b*, 51*a*, 51*b*, 52*a*, 52*b*, 53*a*, 53*b* (as indicated in FIG. 9) are each cylindrical bodies flattened along an axis of rotation $RR_t$, $RR_z$. On the flat sides, the half-rollers 50*a*, 50*b*, 51*a*, 51*b*, 52*a*, 52*b*, 53*a*, 53*b* form plane sliding surfaces GF on which the two half-rollers 50*a*, 50*b*, 51*a*, 51*b*, 52*a*, 52*b*, 53*a*, 53*b* of a roller pair 50, 51, 52, 53 are in contact with each other.

The half-rollers 50*a*, 50*b*, 51*a*, 51*b*, 52*a*, 52*b*, 53*a*, 53*b* are located in the radial direction inside the reference circle of the piston 10 and at a distance from the axes of rotation $R_t$, $R_z$. The cone-beam semi-roller joint 31 can be located compactly inside the reference circle of the pistons 10 and the drive shaft 4 so the transfer of the torque can be located radially inside the half-rollers of the cone-beam semi-roller joint 31.

Each roller pair 50-53 has one cylinder-drum-side half-roller 50*a*, 51*a*, 52*a*, 53*a* that belongs to the cylinder drum 7 and one drive shaft-side roller 50*b*, 51*b*, 52*b*, 53*b* that belongs to the drive shaft 4, which are in contact with each other at the plane sliding surfaces GF.

The cylinder-drum-side half-rollers 50*a*, 51*a*, 52*a*, 53*a* of the corresponding roller pair are each located in a cylindrical or partly cylindrical cylinder-drum-side receptacle 55*a*, 56*a*, 57*a*, 58*a* and the drive-shaft-side half-rollers 50*b*, 51*b*, 52*b*, 53*b* of a roller pair 50-53 are each located in a cylindrical or partly cylindrical drive-shaft-side receptacle 55*b*, 56*b*, 57*b*, 58*b*.

The half-rollers 50*a*, 50*b*, 51*a*, 51*b*, 52*a*, 52*b*, 53*a*, 53*b* are each secured in the respective cylindrical receptacles 55*a*, 56*a*, 57*a*, 58*a*, 55*b*, 56*b*, 57*b*, 58*b* in the longitudinal direction of the corresponding axis of rotation.

Each half-roller 50*a*, 50*b*, 51*a*, 51*b*, 52*a*, 52*b*, 53*a*, 53*b* is provided in the cylindrical section with a collar 60 which is engaged in a groove 61 of the corresponding receptacle 55*a*, 56*a*, 57*a*, 58*a*, 55*b*, 56*b*, 57*b*, 58*b*.

Figure 4:
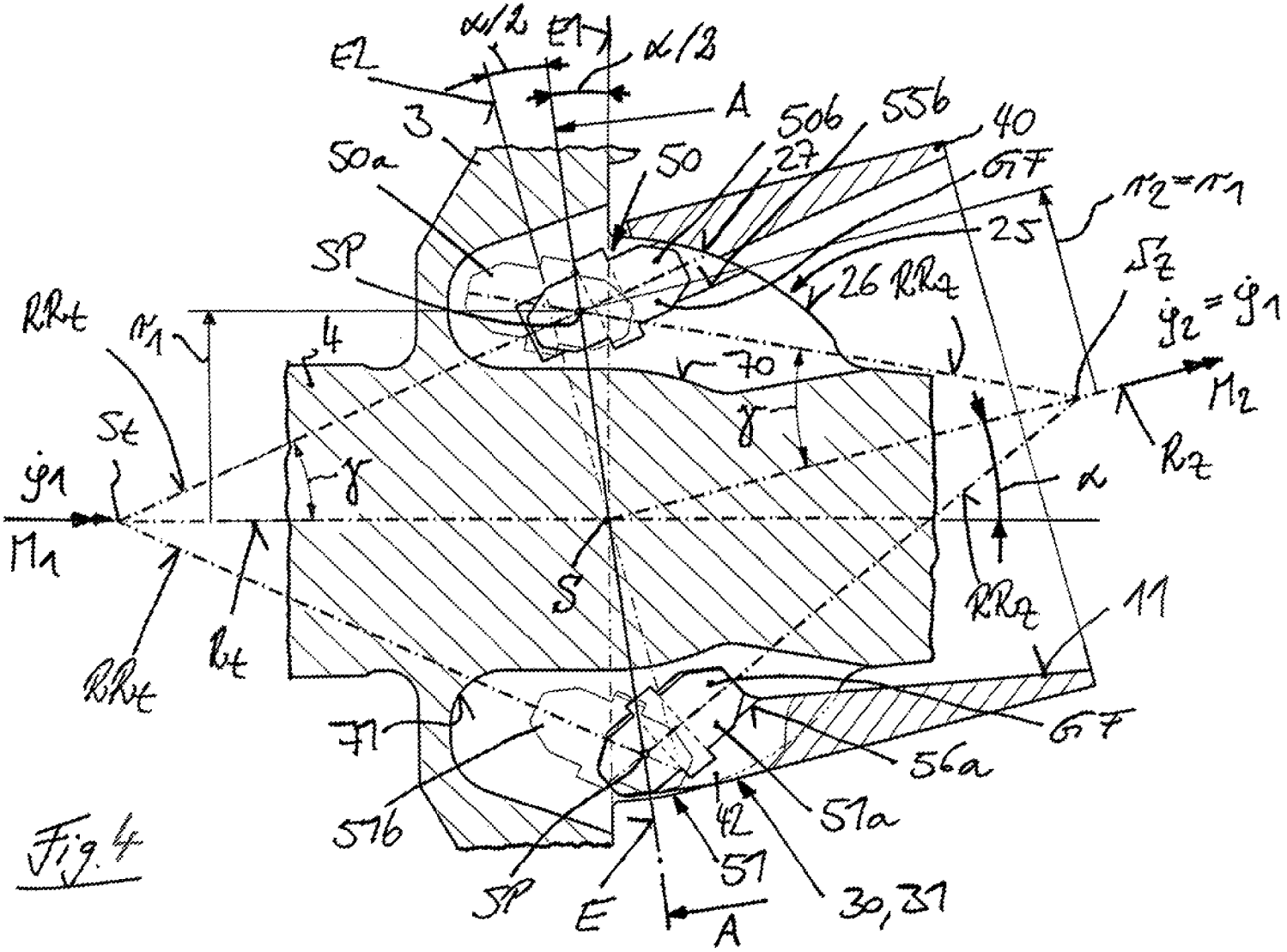
FIG. 4 is an enlarged detail from FIGS. 1 to 3 in the vicinity of the drive joint (in the form of a constant velocity joint)

In FIG. 4, the drive-shaft-side half-roller 50*b* of the roller pair 50 is indicated in thick lines and the cylinder-drum-side half-roller 50*a* that is in contact with the half-roller 50*b* is indicated in thin lines. The cylinder-drum-side half-roller 51*a* of the roller pair 51 is indicated in thick lines and the drive-shaft-side half-roller 51*b* that is in contact with the half-roller 51*a* is indicated in thin lines. The flattened, planar, sliding services GF of the half-rollers 50*b* and 51*a* that lie in the plane of the section in FIG. 4 are illustrated.

In the cone-beam semi-roller joint 31 (as illustrated in FIG. 4) the axes of rotation $RR_t$ of the drive-shaft-side half-rollers 50*b*, 51*b*, 52*b*, 53*b* are inclined at an angle of inclination γ with respect to the axis of rotation $R_t$ of the drive shaft 4. The axes of rotation $RR_t$ of the drive-shaft-side half-rollers 50*b*, 51*b*, 52*b*, 53*b* intersect the axis of rotation $R_t$ of the drive shaft 4 at the point of intersection $S_t$.

The individual axes of rotation $RR_t$ of the plurality of drive-shaft-side half-rollers 50*b*, 51*b*, 52*b*, 53*b* form a cone-beam (illustrated in FIG. 4) around the axis of rotation $R_t$ of the drive shaft 4 with the apex at the point of intersection $S_t$.

The axes of rotation $RR_z$ of the cylinder-drum-side half-rollers 50*a*, 51*a*, 52*a*, 53*a* are correspondingly inclined by an angle of inclination γ with reference to the axis of rotation $R_z$ of the cylinder drum 7. The axes of rotation $RR_z$ of the cylinder-drum-side half-rollers 50*a*, 51*a*, 52*a*, 53*a* intersect the axis of rotation $R_z$ of the cylinder drum 7 at the point of intersection $S_z$. The individual axes of rotation $RR_z$ of the plurality of cylinder-drum-side half-rollers 50*a*, 51*a*, 52*a*, 53*a* form a conical beam (illustrated in FIG. 4) around the axis of rotation $R_z$ of the cylinder drum 7, with the apex at the point of intersection $S_z$.

The angles of inclination γ of the axes of rotation $RR_z$ of the cylinder-drum-side half-rollers 50*a*, 51*a*, 52*a*, 53*a* with respect to the axis of rotation $R_z$ of the cylinder drum 7 and the axes of rotation $RR_t$ of the drive shaft side half-rollers 50*b*, 51*b*, 52*b*, 53*b* with respect to the axis of rotation $R_t$ of the drive shaft 4 are identical. The angles of inclination γ of the axes of rotation $RR_z$, $RR_t$ of the half-rollers of the drive shaft 4 and cylinder drum 7 to be coupled to each other are therefore equal. Consequently, on the corresponding roller pairs 50-53, the axes of rotation $RR_t$ that belong to the drive shaft 4 and the axes of rotation $RR_z$ that belong to the cylinder drum 7 of the two half-rollers that form a roller pair intersect in pairs in a plane E which corresponds to the line bisecting the angle between the axis of rotation $R_t$ of the drive shaft 4 and the axis of rotation $R_z$ of the cylinder drum 7. The points of intersection SP that lie in the plane E, in which the respective axes of rotation $RR_t$ belonging to the drive shaft 4 intersect in pairs with the axis of rotation $RR_z$ belonging to the cylinder drum 7 of the two half-rollers that form a roller pair, are illustrated in FIG. 4. The plane E is inclined at one-half the angle of inclination or pivoting angle α/2 with respect to a plane E1 (which is perpendicular to the axis of rotation $R_t$ of the drive shaft 4) and a plane E2 (which is perpendicular to the axis of rotation $R_z$ of the cylinder drum 7). The plane E passes through the point of intersection S of the axes of rotation $R_t$, $R_z$.

The half-rollers 50*a*, 50*b*, 51*a*, 51 *b*, 52*a*, 52*b*, 53*a*, 53*b* of the respective roller pairs 50, 51, 52, 53 are located in the vicinity of the points of intersection SP of the axes of rotation $RR_t$, $RR_z$, as a result of which the force transmission between the plane sliding surfaces GF for the drive of the cylinder drum 7 takes place at the points of intersection SP of the two half-rollers of the respective roller pair 50-53.

On account of the position of the points of intersection SP of the two half-rollers of the respective roller pairs 50-53 in the plane E that bisects the angle, the perpendicular radial distances $r_1$, $r_2$ of the points of intersection SP from the axis of rotation $R_t$ of the drive shaft 4 and the axis of rotation $R_z$ of the cylinder drum 7 are equal. On account of the equal lever arms formed by the radial distances $r_1$, $r_2$ of the points of intersection, there are equal angular velocities ϕ1 of the drive shaft 4 and ϕ2 of the cylinder drum 7, as a result of which the cone-beam semi-roller joint 31 forms a constant velocity joint which makes possible a precisely rotationally synchronous drive and rotation of the cylinder drum 7.

In the axial piston machine 1, during rotation of the drive shaft 4, with an inclination of the axis of rotation $R_z$ of the cylinder drum 7 with respect to the axis of rotation $R_t$ of the drive shaft 4 at the angle of inclination or pivoting angle α, a sliding of the two sliding surfaces GF of the two half-rollers of each roller pair 50-53 takes place. There is also a rotation of the respective semi-cylindrical half-roller around the respective axes of rotation $RR_t$ and $RR_z$ in the bed of the corresponding half-roller formed by the cylindrical receptacle 55*a*, 56*a*, 57*a*, 58*a*, 55*b*, 56*b*, 57*b*, 58*b*. On account of the inclination of the axes of rotation $RR_t$, $RR_z$ of the half-rollers 50*a*, 50*b*, 51*a*, 51*b*, 52*a*, 52*b*, 53*a*, 53*b* arranged in pairs with respect to one another, the plane surfaces, and, thus, the sliding surfaces GF of the half-rollers in contact with each other, can be oriented with respect to one another by rotation in the corresponding receptacles 55*a*, 56*a*, 57*a*, 58*a*, 55*b*, 56*b*, 57*b*, 58*b*.

The axial piston machine 1 illustrated in FIG. 1 can be operated in both directions of rotation. To achieve a rotationally synchronous drive of the cylinder drum 7 in both directions of rotation, at least one roller pair 50-53 is provided for each direction of rotation and, thus, for each direction of torque of the drive torque for the drive of the cylinder drum 7.

Figure 5:
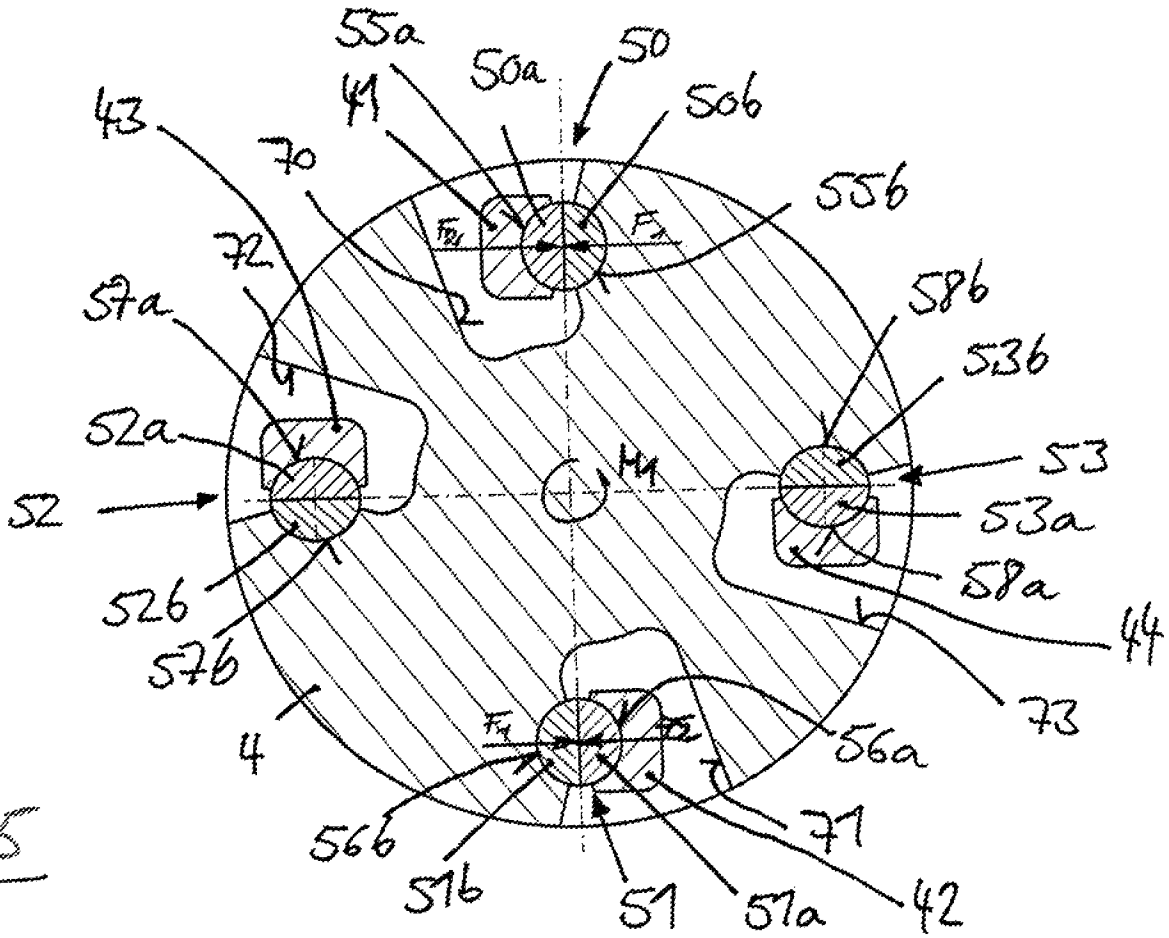
FIG. 5 shows a section along line A-A in FIG. 4 with the transmission forces that occur on the drive joint for a first direction of rotation.

In the illustrated embodiment, the roller pairs 50, 51 are used to drive the cylinder drum 7 during a rotation of the drive shaft 4 in the counterclockwise direction. FIG. 5 shows, for this direction of rotation of the drive shaft 4, the forces F1, F2 which are transmitted at the plane sliding surfaces GF of the half-rollers 50*a*, 50*b* and 51*a*, 51*b* of the roller pairs 50, 51, which generate the drive torque M2 for the drive of the cylinder drum 7. By means of the drive shaft 4, the torque M1 is applied, and the force F1 is applied at the drive-shaft-side half-rollers 50*b*, 51*b* which, by means of the force F2 that occurs on the cylinder-drum-side half-rollers 50*a*, 51 *a*, generate the drive torque M2 for the drive of the cylinder drum 7.

Figure 6:
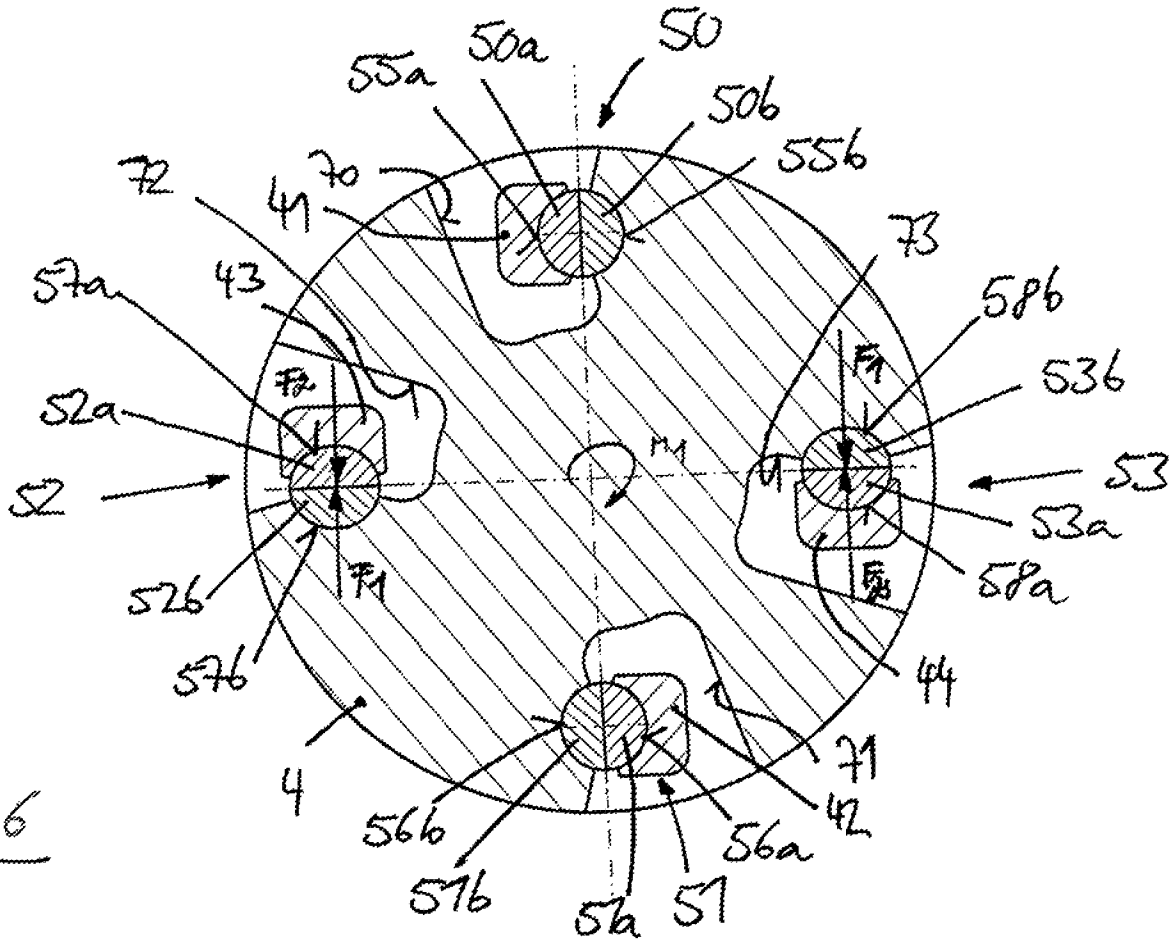
FIG. 6 shows a section along the line A-A in FIG. 4 with the transmission forces that occur on the drive joint for a second, opposite direction of rotation.
Figure 7:
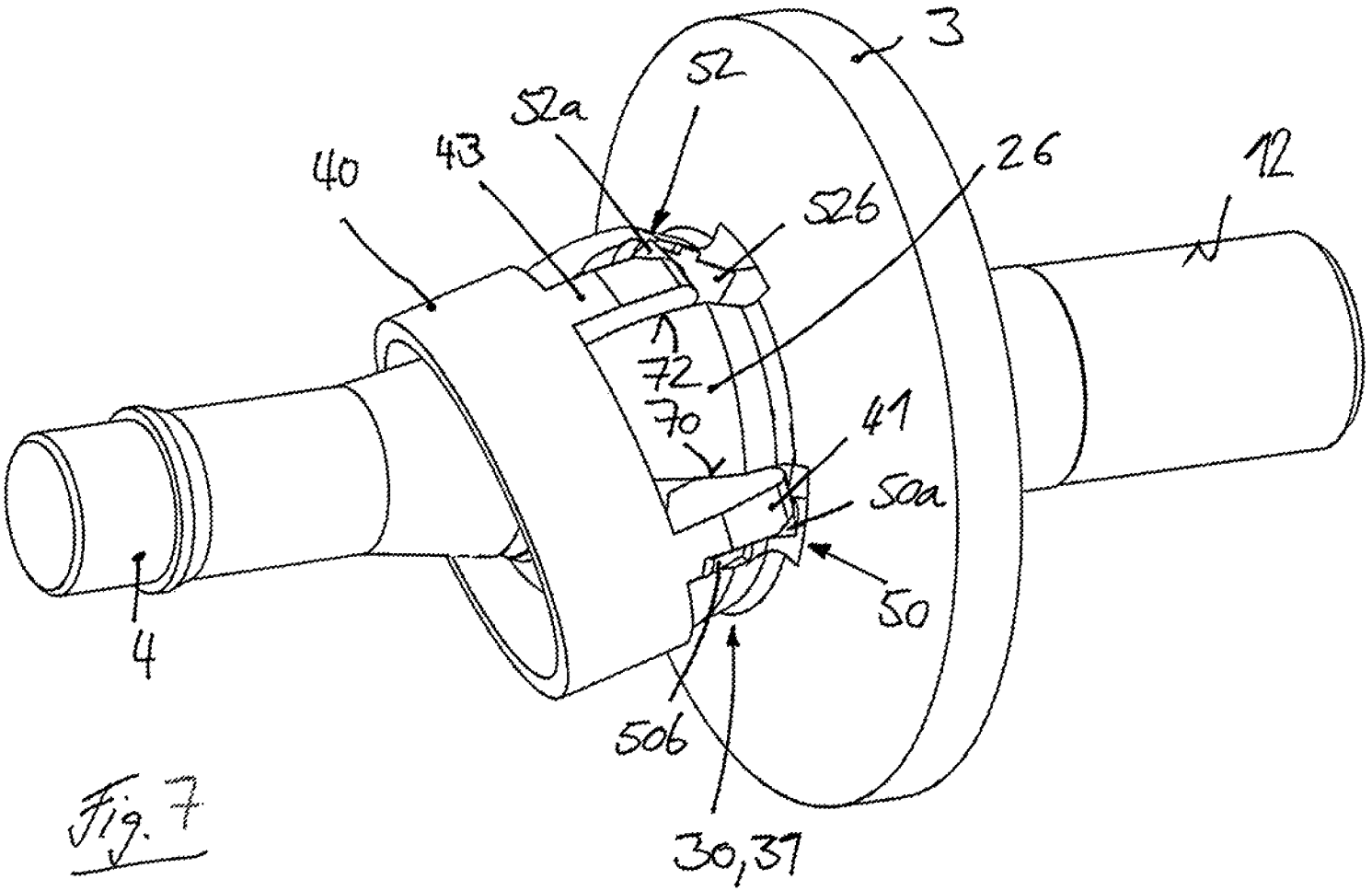
FIG. 7 shows the drive joint between the drive shaft and the driver element of the cylinder drum in a three-dimensional representation.
Figure 8:
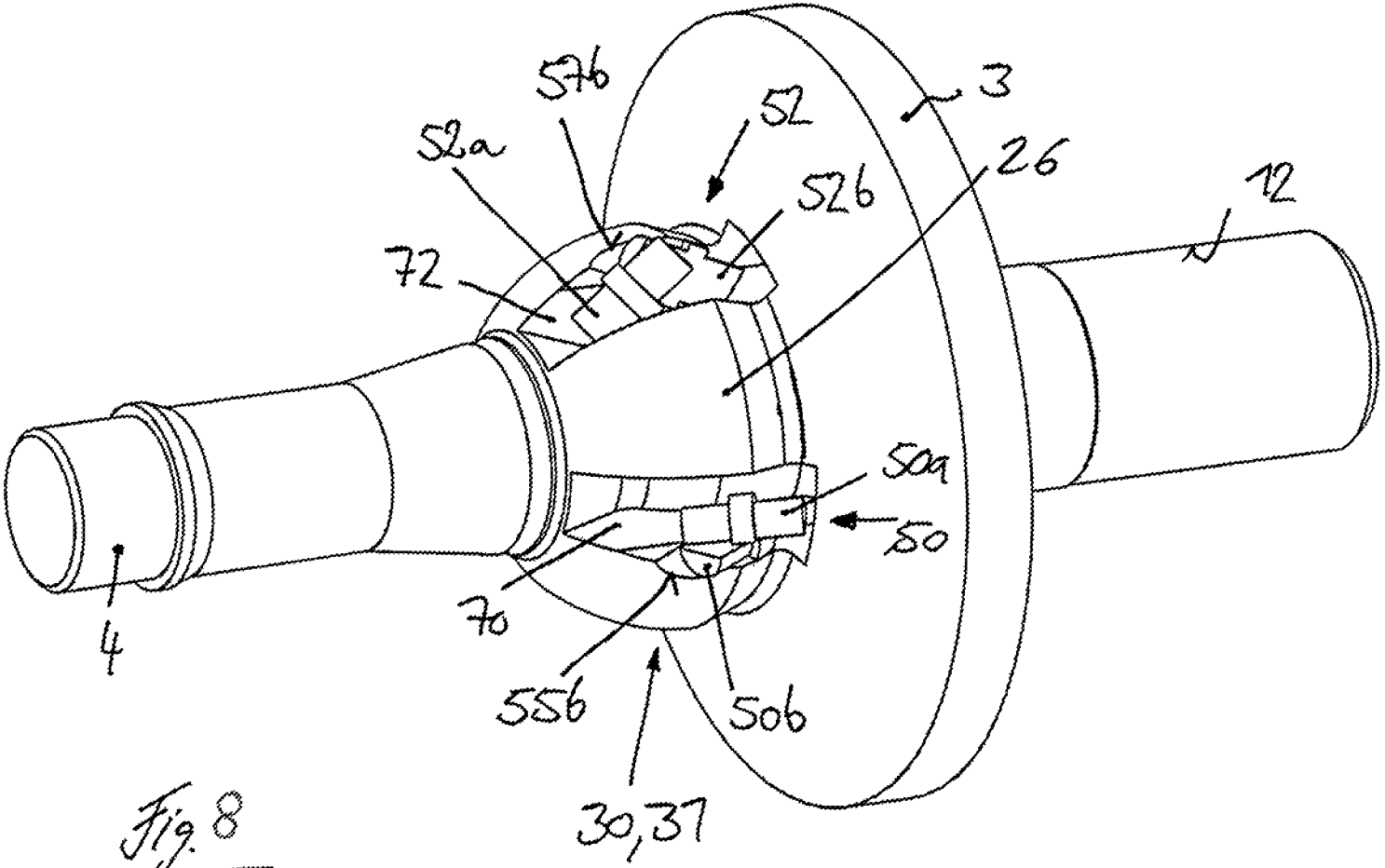
FIG. 8 shows the arrangement in FIG. 7 with the roller pairs of the drive joint with the drive joint removed.

In the illustrated exemplary embodiment, the roller pairs 52, 53 are used to drive the cylinder drum 7 in an opposite direction of rotation to the drive shaft 4 in the clockwise direction. FIG. 6 shows, for this direction of rotation of the drive shaft 4, the forces F1, F2 which are transmitted at the planar sliding surfaces GF of the half-rollers 52*a*, 52*b* and 53*a*, 53*b* of the roller pairs 52, 53 from the torque M1 acting on the drive shaft 4, which forces F1, F2 generate the drive torque M2 for the drive of the cylinder drum 7. By means of the drive shaft 4, the torque M1 is applied, and at the drive shaft side half-rollers 52*b*, 53*b* the force F1 is applied, which, by means of the force F2 that occurs on the cylinder-drum-side half-rollers 52*a*, 53*a*, generate the drive torque M2 for the drive of the cylinder drum 7.

In the illustrated exemplary embodiment, there are two roller pairs 50, 51 and 52, 53 for each direction of rotation. The roller pairs 50, 51 for the first direction of rotation and the roller pairs 52, 53 for the second direction of rotation are uniformly distributed over the periphery. This arrangement makes possible an equalization of the radial forces. In the illustrated exemplary embodiment with two roller pairs for each direction of rotation, the roller pairs 50, 51 are offset by a rotational angle of 180° and the roller pairs 52, 53 are offset by a rotational angle of 180°. The roller pairs 50, 51 for the first direction of rotation are offset from the roller pairs 52, 53 for the second direction of rotation by a rotational angle of 90°.

In the illustrated exemplary embodiment, the drive-shaft-side receptacles 55*b*, 56*b*, 57*b*, 58*b* for the drive-shaft side half-rollers 50*b*, 51*b*, 52*b*, 53*b* are located in the drive shaft 4. The drive shaft 4 is provided in the vicinity of the spherical segment 26 with pocket-shaped recesses 70, 71, 72, 73, on the side surfaces of each of which there is a drive-shaft-side receptacle 55*b*, 56*b*, 57*b*, 58*b*.

In the illustrated exemplary embodiment, the cylinder-drum-side receptacles 55*a*, 56*a*, 57*a*, 58*a* for the cylinder-drum-side half-rollers 50*a*, 51*a*, 52*a*, 53*a* are located in the sleeve-shaped driver element 40. The sleeve-shaped driver element 40 is provided with finger-shaped protrusions 41, 42, 43, 44 which extend toward the drive shaft 4 and in each of which there is a cylinder-drum-side receptacle 55*a*, 56*a*, 57*a*, 58*a*. The sleeve-shaped driver element 40 is also provided with the segment 27 in the form of a hollow sphere of the spherical guide 25.

Each finger-shaped protrusion 41, 42, 43, 44 of the driver element 40 is engaged in an associated pocket-shaped recess 70, 71, 72, 73 of the drive shaft 4.

Figure 2:
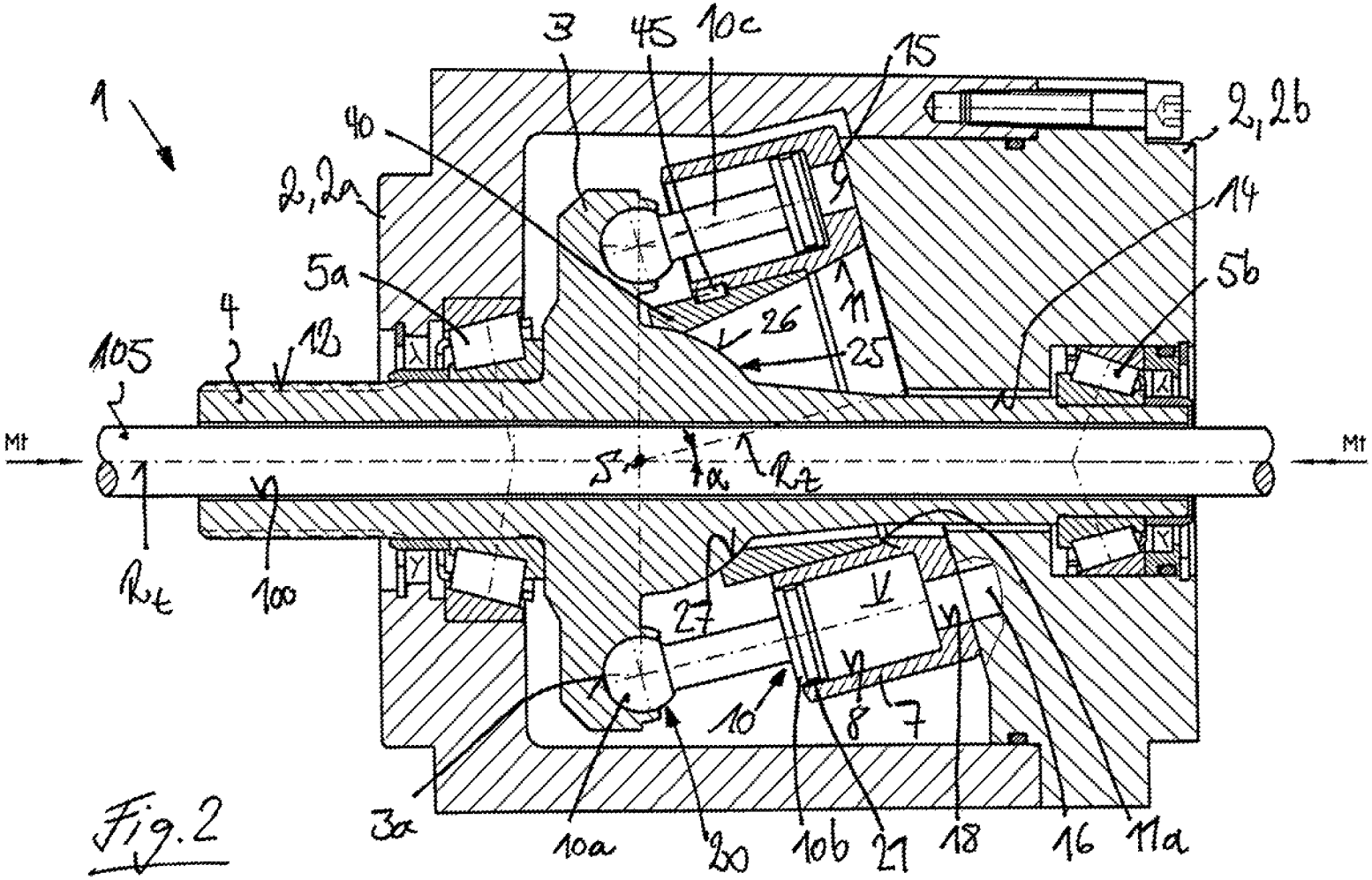
FIG. 2 is a longitudinal section of a second exemplary embodiment of a bent-axis machine of the invention.
Figure 3:
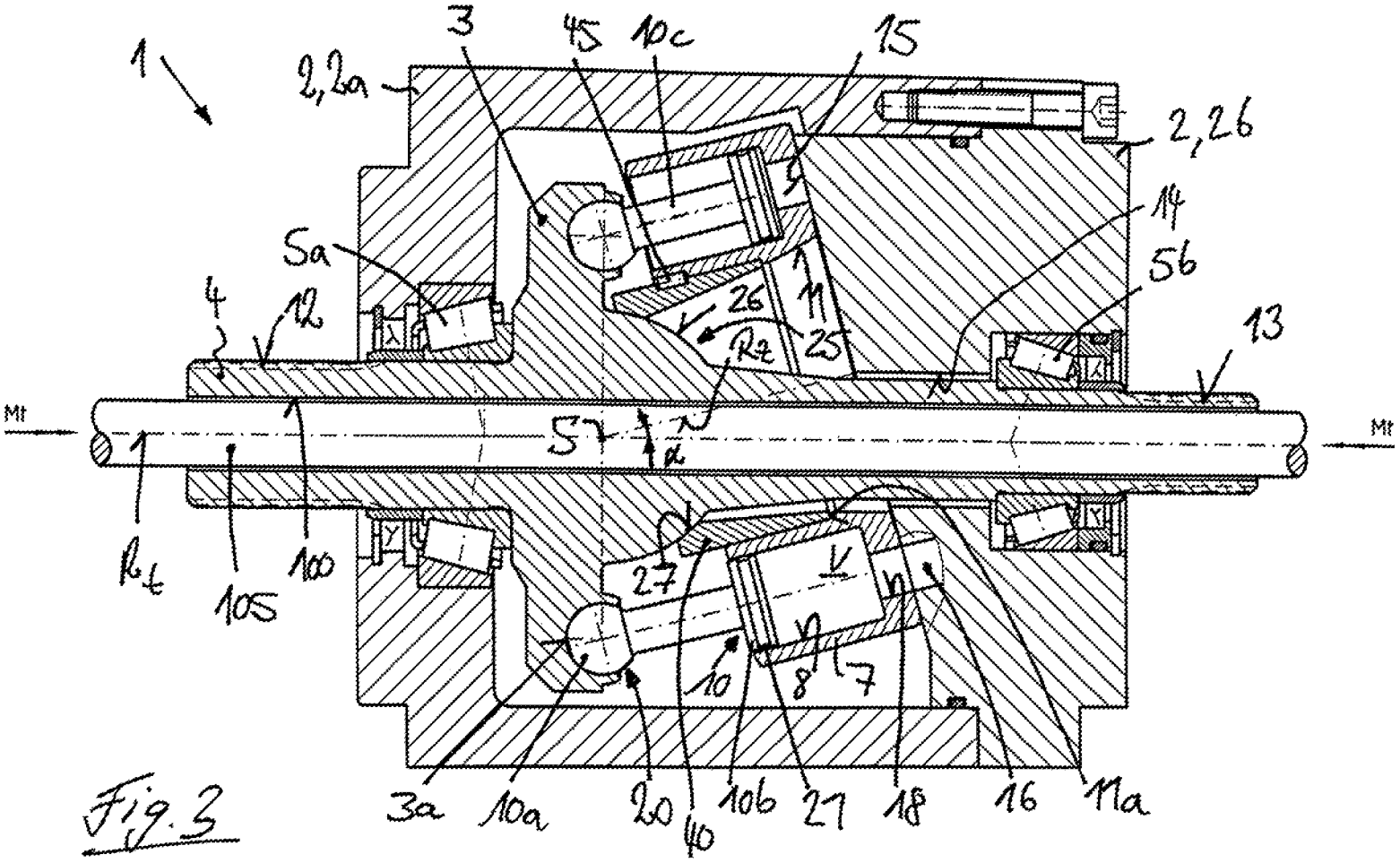
FIG. 3 is a longitudinal section of a third exemplary embodiment of a bent-axis machine of the invention.

FIGS. 2 and 3 illustrate additional exemplary embodiments of an axial piston machine of the invention that employs a bent-axis construction. Components that are identical with those in FIG. 1 are identified by the same reference numbers. The exemplary embodiments illustrated in FIGS. 2 and 3 are identical with FIGS. 4 to 12 with regard to the construction of the cone-beam semi-roller joint 31 in the form of a constant velocity joint for the drive of the cylinder drum 7.

On the axial piston machine 1 illustrated in FIG. 2, the drive shaft 4 is a hollow shaft provided with a longitudinal boring 100 which is concentric and coaxial with the axis of rotation $R_t$. Located in the longitudinal boring 100, concentric to the axis of rotation $R_t$, is a torque bar 105 which is routed through the drive shaft 4. By means of the torque bar 105, a torque Mt can be transmitted by a torque transfer through the axial piston machine 1. The torque bar 105 has no mechanical operative connection with the drive shaft 4. The drive shaft 4 and the torque bar 105 can therefore rotate at different speeds of rotation and/or in different directions of rotation.

In the exemplary embodiment illustrated in FIG. 2, the drive shaft 4 is provided with torque transmission means 12 only on the drive flange side end and for the introduction or tapping of a drive torque. The cylinder-drum-side end of the drive shaft 4 is in the vicinity of the housing cover 2*b*.

FIG. 3 illustrates an exemplary embodiment of an axial piston machine 1 in which the drive shaft 4 is analogous to the hollow shaft illustrated in FIG. 2 and with the coaxial longitudinal bore 100 through which the torque bar 105 is routed. The drive shaft 4 analogous to FIG. 1 is provided with torque transmission means 12 on the drive-flange-side end and with torque transmission means 13 on the cylinder-drum-side end that extends out of the housing cover 2*b*.

An axial piston machine 1 of the invention with a constant velocity joint for the drive of the cylinder drum 7 and a torque transfer capability has a series of advantages.

The constant velocity joint in the form of a cone-beam semi-roller joint 31 makes possible in a simple manner, as a result of the location of the half-rollers by means of the longitudinal bore 11, the ability to transfer a torque to the cylinder-drum side of the axial piston machine 1. The constant velocity joint in the form of a cone-beam semi-roller joint 31 can be constructed by a corresponding choice of the angle of inclination $\gamma$ of the axes of rotation $RR_z$, $RR_t$ of the half-rollers as a homokinetic constant velocity joint. The cone-beam semi-roller joint 31 which forms the constant velocity joint is suitable for use in axial piston machines 1 with a constant or variable displacement volume. In a variable displacement machine, no play results when the cylinder drum 7 pivots back to a reduced displacement volume. An additional significant advantage of the cone-beam semi-roller joint 31 is that the drive shaft 4 can be routed through the cylinder drum 7 and the axial piston machine 1 to create a torque transfer capability. The drive shaft 4 can be mounted on both sides of the cylinder drum 7 in the housing 2, which has advantages in terms of a compact construction of the axial piston machine 1 in the axial direction. The cone-beam semi-roller joint 31 has area contact. As a result of the area contact on the plane sliding surfaces GF of the two half-rollers of the roller pair 51-53, only low Hertzian stresses occur, as a result of which the cone-beam semi-roller joint 31 is not sensitive to and is robust in terms of its ability to withstand overloads which can occur, for example, as a result of high rotational acceleration. The cone-beam semi-roller joint 31 is therefore suitable for use in an axial piston machine 1, preferably a hydraulic motor, in applications with high rotational accelerations. On account of the low stresses that occur from the area contact on the plane sliding surfaces GF of the half-rollers, only a surface treatment to protect against wear is necessary on the half-rollers on the flat and flattened sliding surfaces GF. There is no need for a depth hardening of the half-rollers. As a result of the limited surface hardening of the half-rollers, which can be achieved by nitriding, for example, there is only a small change in the dimensions of the half-rollers so that a mechanical repair or finishing of the half-rollers is unnecessary. The low cost and the low amount of effort required for the manufacture of the half-rollers of the cone-beam semi-roller joint 31 results in little extra construction cost or effort for the axial piston machine 1 claimed by the invention.

On the axial piston machine 1 claimed of the invention, the function of the torque drive of the cylinder drum 7 by the cone-beam semi-roller joint 31 and the function of the support of the cylinder drum 7 by the spherical guide 25 are separate. Both functions are simple and economical to manufacture on account of the geometrically simple surfaces and components required. In particular, the receptacles for the half-rollers of the cone-beam semi-roller joint 31 and the half-rollers themselves can be manufactured easily and economically.

The invention is not restricted to the illustrated exemplary embodiments. The exemplary embodiments illustrated in FIGS. 1 to 3, as an alternative to the illustrated constant displacement machine, can also be in the form of a variable displacement machine. On a variable displacement machine, the angle of inclination $\alpha$ of the axis of rotation $R_z$ of the cylinder drum 7 with respect to the axis of rotation $R_t$ of the drive shaft 4 can be adjusted to vary the displacement volume. The control surface 15 with which the cylinder drum 7 is in contact is for this purpose in the form of a rocker body, which is pivotably located in the housing 2.

The cone-beam semi-roller joint 31 is not restricted to the illustrated number of roller pairs. It goes without saying that for higher drive torques M2 of the cylinder drum 7 to be transmitted, instead of two pairs of rollers for each direction of rotation, a higher number of roller pairs can be used. Correspondingly, for lower drive torques M2 of the cylinder drum 7 to be transmitted, only one single roller pair per direction of rotation can be provided.

If the axial piston machine is only operated in one direction of rotation, one roller pair or a plurality of roller pairs are required only for the desired direction of rotation to be able to transmit the drive torque M2 to the cylinder drum 7.

The drive-shaft-side receptacles 55*b*, 56*b*, 57*b*, 58*b* for the housing and support of the drive-shaft-side half-rollers 50*b*, 51*b*, 52*b*, 53*b*, as an alternative to being located in the drive shaft 4, can be located in the drive flange 3 or in a component that is connected in a torque-proof manner with the drive shaft 4. The drive flange 3 and the drive shaft 4 can also be separate, in which case the drive flange 3 is connected in a torque-proof manner with the drive shaft 4 by appropriate torque transmission means, such as gear teeth. When the drive shaft 4 and the drive flange 3 are separate components, the drive-shaft-side receptacles 55*b*, 56*b*, 57*b*, 58*b* for the housing of the drive-shaft-side half-rollers 50*b*, 51*b*, 52*b*, 53*b* can also optionally be located in the drive flange 3 or the drive shaft 4.

The axial piston machine 1 can be in the form of a hydraulic motor or in the form of a hydraulic pump.

The torque transfer capability on the drive shaft 4 equipped with torque transmission means 12, 13 on both ends makes it possible, when the axial piston machine 1 is used as a hydraulic pump, to locate a plurality of hydraulic pumps one behind another and drive them by means of the transfer of the torque. The torque transfer capability on the drive shaft 4 equipped with torque transmission means 12, 13 on both ends makes it possible, when the axial piston machine 1 is used as a hydraulic motor, to locate a plurality of hydraulic motors one behind another and to increase the output torque a torque transfer. The torque transfer capability on the drive shaft 4 equipped on both ends with the torque transmission means 12, 13 makes it possible, on an axial piston machine 1 used as a hydraulic motor, to tap an output torque on both shaft ends of the drive shaft 4. This arrangement results in advantages in a traction drive, in which the drive shaft 4 is connected with different driven wheels or different driven axles of a vehicle.

The construction of the drive shaft 4 as a hollow shaft with a torque bar 105 that runs through the hollow shaft makes it possible to achieve a torque transfer through the axial piston machine 1 by means of the torque bar 105, and by means of the torque bar 105, to transfer the torque Mt inside the axial piston machine 1 through the axial piston machine 1. The torque bar 105 and the drive shaft 4 can have different speeds of rotation and/or different directions of rotation. The transfer of a torque through the torque bar 105 located in the interior of the drive shaft 4 results in the universal applicability of the axial piston machine 1 and has particular advantages when the axial piston machine 1 is used in a power split transmission.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A hydrostatic axial piston machine utilizing a bent-axis construction, comprising:

a drive shaft rotatable around a drive shaft axis of rotation and provided with a drive flange;

a cylinder drum rotatable around a cylinder drum axis of rotation;

a plurality of piston bores located in the cylinder drum and concentric to the axis of rotation of the cylinder drum;

a longitudinally displaceable piston located in each piston bore, wherein the pistons are fastened in an articulated manner to the drive flange; and a drive joint between the drive shaft and the cylinder drum, wherein the drive joint is a constant velocity joint for synchronous rotation of the cylinder drum and of the drive shaft, wherein the drive joint and the cylinder drum include a longitudinal bore concentric to the axis of rotation of the cylinder drum, and wherein the drive shaft provided with the drive flange extends through the cylinder drum via the longitudinal bore such that there is a torque transfer to a cylinder-drum-side end of the axial piston machine in the vicinity of the drive shaft, wherein the drive joint is a cone-beam semi-roller joint, wherein the cone-beam semi-roller joint includes at least one roller pair with two semi-cylindrical half-rollers, and wherein the semi-cylindrical half-rollers are flattened along an axis of rotation and the half-rollers form flat sliding surfaces on the flattened sides at which the half-rollers of the roller pair are in contact with each other.

2. The hydrostatic axial piston machine as recited in claim 1, wherein the drive shaft is mounted in a housing of the axial piston machine on both sides of the cylinder drum.

3. The hydraulic axial piston machine as recited in claim 1, wherein for the transfer of the torque, the drive shaft includes torque transmission means on both ends thereof.

4. The hydrostatic axial piston machine as recited in claim 1, wherein the drive shaft is a hollow shaft through which a torque bar that is routed through the axial piston machine extends.

5. The hydrostatic axial piston machine as recited in claim 4, wherein the torque bar is not mechanically connected to the drive shaft.

6. The hydrostatic axial piston machine as recited in claim 1, wherein the half-rollers are located in the radial direction inside the pistons and at a distance from the axes of rotation of the drive shaft and of the cylinder drum.

7. The hydrostatic axial piston machine as recited in claim 1, wherein each roller pair includes a cylinder-drum-side half-roller associated with the cylinder drum and a drive-shaft-side half-roller associated with the drive shaft, wherein the cylinder-drum-side half-roller of a roller pair is located in a cylindrical or partly cylindrical cylinder-drum-side receptacle and the drive-shaft-side half-roller of a roller pair is located in a cylindrical or partly cylindrical drive-shaft-side receptacle.

8. The hydrostatic axial piston machine as recited in claim 7, wherein each respective half-roller located in a cylindrical receptacle is secured in the respective receptacle in the longitudinal direction of the axis of rotation of the half-roller.

9. The hydrostatic axial piston machine as recited in claim 8, wherein the half-rollers are provided on the cylindrical section with a collar engaged in a groove of the receptacle.

10. The hydrostatic axial piston machine as recited in claim 7, wherein the drive-shaft-side receptacles are located in the drive shaft or in the drive flange.

11. The hydrostatic axial piston machine as recited in one of the claim 7, wherein the drive-shaft-side receptacle is located in a component that is connected in a torque-proof manner with the drive shaft.

12. The hydrostatic axial piston machine as recited in claim 7, wherein the cylinder-drum-side receptacle is located in a sleeve-shaped driver element located in the longitudinal bore of the cylinder drum and is connected in a torque-proof manner with the cylinder drum, and wherein the drive shaft extends through the sleeve-shaped driver element.

13. The hydrostatic axial piston machine as recited in claim 12, wherein between the drive shaft and the sleeve-shaped driver element, there is a spherical guide formed by a sphere and a spherical shell for mounting of the cylinder drum.

14. The hydrostatic axial piston machine as recited in claim 12, wherein the driver element includes at least one finger-shaped protrusion which extends toward the drive shaft and in each of which there is a cylinder-drum-side receptacle for a cylinder-drum-side half-roller.

15. The hydrostatic axial piston machine as recited in claim 14, wherein the drive shaft or the drive flange or the component connected in a torque-proof manner with the drive shaft includes at least one pocket-shaped recess in which the driver element is engaged with at least one finger-shaped protrusion, and wherein in each pocket-shaped recess there is a drive-shaft-side receptacle for a drive-shaft side half-roller.

16. The hydrostatic axial piston machine as recited in claim 1, wherein the axis of rotation of the drive shaft-side half-roller is inclined with respect to the axis of rotation of the drive shaft at a first angle of inclination and intersects the axis of rotation of the drive shaft, and wherein the axis of rotation of the cylinder-drum-side half-roller is inclined with respect to the axis of rotation of the cylinder drum at a second angle of inclination and intersects the axis of rotation of the cylinder drum.

17. The hydrostatic axial piston machine as recited in claim 16, wherein the first and second angles of inclination are identical and the axis of rotation of the cylinder-drum-side half-rollers and the axis of rotation of the drive-shaft-side half-roller of each roller pair intersect in a plane perpendicular to a line bisecting the angle between the axis of rotation of the drive shaft and the axis of rotation of the cylinder drum, and wherein the half-rollers of a roller pair are located in a vicinity of a point of intersection of the axes of rotation of the half-rollers.

18. The hydrostatic axial piston machine as recited in claim 1, wherein the axial piston machine is operable in both directions of rotation, and further includes at least one roller pair for each direction of rotation for rotationally synchronous drive of the cylinder drum.

19. The hydrostatic axial piston machine as recited in claim 1, including a plurality of roller pairs distributed over a periphery.

20. The hydrostatic axial piston machine as recited in claim 1, wherein the drive flange is formed in one piece with the drive shaft or the drive flange and the drive shaft are separate parts connected in a torque-proof manner.

21. The hydrostatic axial piston machine as recited in claim 1, wherein the axial piston machine is a constant displacement machine with a fixed displacement volume.

22. A power split transmission with an axial piston machine as recited in claim 1.

* * * * *